US005765084A

United States Patent [19]

Asada et al.

[11] Patent Number: 5,765,084

[45] Date of Patent: Jun. 9, 1998

[54] PRINTING APPARATUS AND A PRINTING METHOD

[75] Inventors: Hiroyoshi Asada, Kyoto; Yuichi Nakao; Jun Inagaki, both of Otsu, all of Japan

[73] Assignee: Toray Industries, Inc., Tokyo, Japan

[21] Appl. No.: 617,831

[22] PCT Filed: Jul. 6, 1995

[86] PCT No.: PCT/JP95/01347

§ 371 Date: Jun. 3, 1996

§ 102(e) Date: Jun. 3, 1996

[87] PCT Pub. No.: WO96/02024

PCT Pub. Date: Jan. 25, 1996

[30] Foreign Application Priority Data

Jul. 7, 1994 [JP] Japan ..... 6-155887

[51] Int. Cl.[6] ..... G03G 15/01

[52] U.S. Cl. ..... 399/302; 399/233; 399/308; 399/310

[58] Field of Search ..... 355/326 R, 327, 355/271–275, 256; 399/298, 302, 308, 310, 233, 237

[56] References Cited

U.S. PATENT DOCUMENTS

| | | | |
|---|---|---|---|
| 3,893,761 | 7/1975 | Buchan et al. | 355/272 |
| 3,947,113 | 3/1976 | Buchan et al. | 355/271 |
| 4,187,774 | 2/1980 | Iwasa et al. | 101/1 |
| 5,117,263 | 5/1992 | Adam et al. | 355/256 |
| 5,182,598 | 1/1993 | Hara et al. | 355/271 X |
| 5,189,478 | 2/1993 | Hara et al. | 355/271 |
| 5,255,058 | 10/1993 | Pinhas et al. | 355/256 |
| 5,300,990 | 4/1994 | Thompson | 355/256 |
| 5,361,126 | 11/1994 | Loonen et al. | 355/271 X |
| 5,370,961 | 12/1994 | Zaretsky et al. | 355/271 X |
| 5,394,232 | 2/1995 | Tamura et al. | 355/327 |
| 5,452,063 | 9/1995 | Fletcher | 355/271 |
| 5,477,313 | 12/1995 | Kuramochi et al. | 355/256 |
| 5,537,194 | 7/1996 | Henry et al. | 355/271 |
| 5,583,629 | 12/1996 | Brewington et al. | 399/302 |
| 5,600,420 | 2/1997 | Saito et al. | 399/302 |

FOREIGN PATENT DOCUMENTS

| | | |
|---|---|---|
| 0 562 524 | 9/1993 | European Pat. Off. . |
| 0 642 062 | 3/1995 | European Pat. Off. . |
| 55146462 A | 11/1980 | Japan . |
| 4138483 A | 5/1992 | Japan . |
| 5273864 A | 10/1993 | Japan . |

*Primary Examiner*—Matthew S. Smith
*Attorney, Agent, or Firm*—Perman & Green, LLP

[57] ABSTRACT

The present invention is a printing apparatus, in which toner images on a latent image bearing member are electrically transferred onto an intermediate transfer member, for recording onto a recording medium, comprising charging the surface of the intermediate transfer member in the same polarity as the toner image whenever each of the toner images is transferred from the latent image bearing member onto the intermediate transfer member.

The present invention can present a printing apparatus and printing method for suppressing the reverse transfer of the toner images onto the photosensitive element when the toner images are transferred in lamination onto the intermediate transfer member, for example, in an electrophotographic printer.

26 Claims, 8 Drawing Sheets

PRINTING APPARATUS AND A PRINTING METHOD

TECHNICAL FIELD

The present invention relates to a printing apparatus and a printing method for electrically transferring toner images developed on a latent image bearing member onto an intermediate transfer member, for recording on a recording medium.

BACKGROUND ART

Known printing apparatuses, for example, electrophotographic printers include a color electrophotographic apparatus disclosed in Japanese Laid-open Patent Application (Kokai) No.1-282571(1989), in which electrostatic latent images formed on a photosensitive element are developed and electrically transferred for lamination onto an intermediate transfer member one after another, and the laminated toner images are fixed and recorded onto a recording medium such as recording paper all at once.

In the conventional printing apparatus, when the toner images developed on a photosensitive element are transferred for lamination onto an intermediate transfer member, the following two conditions must be satisfied.

Firstly, a sufficient electric field must be secured for electrically transferring the toner images from the photosensitive element onto the intermediate transfer member. Usually, the electric field is obtained by applying a bias voltage between the photosensitive element and the intermediate transfer member.

Secondly, any toner image transferred onto the intermediate transfer member must not return to the photosensitive element when the toner image of the next color is transferred, that is, reverse transfer must not occur.

In the conventional printing apparatus, when a toner image is transferred for lamination onto the intermediate transfer member, discharging treatment for compensating the polarity of the previous toner image is effected to allow better transfer of the subsequent toner image.

This is because it is considered that the previous toner image already transferred on the intermediate transfer member is charged in the same polarity as the subsequent toner image, and that the electric charges possessed by the previous toner image change the potential of the surface of the intermediate transfer member toward the same polarity as the charges of the toner image, acting in the direction to prevent the transfer of the subsequent toner image.

The above discharging treatment also removes the charges owned by the insulation layer on the surface of the intermediate transfer member, to satisfy the above first condition.

However, the discharging treatment decreases the charges owned by the toner image or reverses the polarity, to lower the electrostatic attractive force between the toner image and the intermediate transfer member. For this reason, the toner image is liable to leave from the intermediate transfer member, and when the next toner image is transferred from the photosensitive element to the intermediate transfer member, the previous toner image is transferred back to the photosensitive element as a problem of this technique.

The present invention has been completed in view of the above problem. A purpose of the present invention is to present a printing apparatus and a printing method which can prevent the reverse transfer of the previous toner image when the subsequent toner image is transferred for lamination onto the intermediate transfer member, without the need for any new device.

On the other hand, for a printing apparatus in which electrostatic latent images formed on a photosensitive drum are developed by developer liquid and the developed toner image are transferred and fixed on a recording medium such as recording paper, for example, an electrophotographic printer, it is known that a bias voltage is forcibly applied to an excess developer liquid removing roller used for removing excess developer liquid from the latent image bearing member (Japanese Patent Publication (Kokoku) No.1-43307 (1989)), and that excess developer liquid on the photosensitive drum with toner images developed is removed by a self bias method (Japanese Patent Publication (Kokoku) No.57-48789(1982)) for the purpose to improve the image quality by preventing toner images from breaking However, the liquid removal method disclosed in Japanese Patent Publication (Kokoku) No.1-43307(1989) requires an external power supply for applying the bias voltage, to make the structure complicated as a disadvantage of this technique.

Furthermore in this removal method, if the photosensitive drum is flawed, a spark is generated between the flaw and the removing roller, to form a white streak in the developed toner image, for lowering the image quality disadvantageously. A device for removing excess developer liquid from the latent image bearing member without using any external power supply is disclosed in Japanese Patent Publication (Kokoku) No.57-48789(1982). This device uses a normal development method, and a constant voltage element (Zener diode) is connected to an excess developer liquid removing member, to induce a bias voltage corresponding to the potential on the latent image bearing member, thereby excess developer liquid is removed.

The Zener diode used in the device disclosed in JP-B-57-48789 makes constant the potential induced in the excess developer liquid removing member by the self bias effect. In general, the voltage induced by the self bias effect varies depending on the potential of the electrostatic latent image formed on the latent image bearing member, and if the printing information volume varies greatly as in an electrostatic latent image obtained from an original with both photos and characters, the voltage induced in response to the printing information volume also varies greatly.

Especially when the above mentioned Zener diode based on the self bias method is used in a printing apparatus adopting the reversal development method, the following problem occurs. In the reversal development method, on the latent image bearing member, the absolute value of the surface potential is small and approaches zero according to the increase of printing information volume in the portions of the electrostatic latent image based on printing information, and the absolute value of the surface potential is large in the white ground portions free from the printing information. For this reason, in the case of an original large in printing information volume, the surface potential of the latent image bearing member becomes small, and the bias voltage induced in the excess developer liquid removing member is too small and approaches zero, not allowing the Zener diode to function effectively.

Moreover, if this state occurs in the excess developer liquid removing member, the toner image developed is liable to be peeled from the latent image bearing member when excess developer liquid is removed, as another problem of this technique. In addition, if the printing information volume greatly varies on one original as in the case of an original with both characters and pictures, the induced bias voltage varies so much as to cause uneven printing corresponding to the variation of potential, for lowering the image quality as a further other problem.

Another purpose of the present invention is to present a printing apparatus and a printing method which suppress the variation of the bias voltage induced by the self bias effect, for decreasing the image quality deterioration caused by the voltage variation.

On the other hand, in a printing apparatus using a development method, such as an electrophotographic printer as disclosed in U.S. Pat. No. 3,367,791, etc., a developing roller and a photosensitive drum are arranged with a clearance kept between them, and toner liquid is supplied in the flow accompanying the rotation of the developing roller onto the photosensitive drum, for developing the electrostatic latent image formed on the photosensitive drum.

In this case, the liquid toner supplied by the developing roller usually forms a developing region between the developing roller and the photosensitive drum in the width direction of the photosensitive drum, and the electrostatic latent image is developed in this developing region.

Furthermore, the developed toner image is heated and fixed on a recording medium such as paper by a transfer means such as a heating roll.

In such an electrophotographic printer, if the circumferential speed of the rotating developing roller is too low, the toner liquid is not sufficiently supplied into the developing region, to lower the density of the printed image as a problem of this technique. On the other hand, if the circumferential speed of the developing roller is extremely high in comparison with the circumferential speed of the photosensitive drum, the printed image becomes uneven in density in the rotating direction of the photosensitive drum, and the unevenness extends in the width direction, to lower the image quality as another problem. A further other purpose of the present invention is to present a printing apparatus and a printing method which allow the formation of images with excellent quality not lowered or uneven in image density.

DISCLOSURE OF THE INVENTION

The printing apparatus of the present invention for achieving the above purposes is an apparatus, in which toner images on a latent image bearing member are electrically transferred onto an intermediate transfer member, for recording onto a recording medium, comprising a charger for charging the surface of the intermediate transfer member in the same polarity as the toner image, at each transfer of the toner image from the latent image bearing member onto the intermediate transfer member. The printing method of the present invention is a method, in which toner images on a latent image bearing member are electrically transferred onto an intermediate transfer member, for recording onto a recording medium, comprising the step of charging the surface of the intermediate transfer member in the same polarity as the toner image, at each transfer of the toner image from the latent image bearing member onto the intermediate transfer member.

Preferably, in the printing apparatus and printing method of the present invention, a surface insulation layer of 5 μm or less in dielectric thickness is formed on the surface of the intermediate transfer member.

In the printing apparatus and printing method of the present invention, if the surface of the intermediate transfer member is charged in the same polarity as the toner image at each transfer of the toner image from the latent image bearing member onto the intermediate transfer member, the electrostatic attractive force between the toner image transferred on the intermediate transfer member and the intermediate transfer member is increased, to decrease the reverse transfer when the subsequent toner image is transferred.

In this case, if a dielectric layer is formed on the surface of the intermediate transfer member, the toner images transferred in lamination can be physically easily removed to allow better transfer onto the recording medium. The increase of the charges accumulated on the dielectric layer becomes an obstacle against the bias voltage applied between the latent image bearing member and the intermediate transfer member, to inhibit the transfer of the toner images from the latent image bearing member onto the intermediate transfer member. From this viewpoint, it is preferable to keep the dielectric thickness of the surface insulation layer at 5 μm or less. If the dielectric thickness of the surface insulation layer is 5 μm or less, the electrostatic capacity between the surface of the intermediate transfer member and the conductive region in the intermediate transfer member is large enough to ideally suppress the variation of the potential on the surface of the intermediate transfer member caused by the charges accumulated in the surface by the above mentioned charging. As a result, when the surface of the intermediate transfer member is charged, the bias electric field for transferring the toner image from the latent image bearing member to the intermediate transfer member is not impaired, to ideally improve the transferability of the toner image from the latent image bearing member to the intermediate transfer member. The dielectric thickness of the surface insulation layer is more preferably 4 μm or less, further more preferably 3 μm or less. If the dielectric thickness is too large, the electrostatic capacity is too small, and the variation of the potential by the charges accumulated in the surface is liable to increase, acting to decrease the bias electric field for transferring the toner image in the region between the latent image bearing member and the intermediate transfer member. On the other hand, if the dielectric thickness of the surface insulation layer is too thin, the electric field by the charging increases, and dielectric breakdown is liable to occur. So, the thinner limit of the preferable range for the dielectric thickness of the surface insulation layer depends on the material used for the surface insulation layer.

The dielectric thickness referred to in the present invention is a value ($d/\epsilon$) obtained by dividing the thickness d of the surface insulation layer formed on the intermediate transfer member by dielectric constant $\epsilon$.

In the present invention, the surface insulation layer refers to the surface layer made of an insulator formed between the surface of the intermediate transfer member and the outermost region electrically connected with the body of the intermediate transfer member, to be the same in potential. For example, the intermediate transfer member is obtained by forming a conductive rubber layer on the surface of a metallic drum, laminating an binding layer made of a binder on the surface of the rubber layer, and furthermore, laminating a dielectric layer made of dielectric material such as silicone rubber on the surface of the binding layer. The surface insulation layer in this case consists of the binding layer and the dielectric layer. When the surface insulation layer is a laminate of plural insulator layers, the dielectric thickness of the surface insulation layer means the sum of the dielectric thicknesses of the respective insulator layers. For example, in the above layer configuration, if the thickness of the binding layer is d1, its dielectric constant is $\epsilon 1$, the thickness of the dielectric layer is d2, and its dielectric constant is $\in 2$, then the dielectric thickness of the surface insulation layer is $(d1/\in 1)+(d2/\in 2)$. The reason is that the electrostatic capacity between the surface of the intermediate transfer member and the body of the intermediate transfer member is the same as the capacity of the binding layer and the dielectric layer connected in series as two capacitors. If the surface of the intermediate transfer member with such a dielectric thickness is charged in the same polarity as the toner image, the toner image only is given the charges, and even in this case, the transfer of the toner image for lamination onto the intermediate transfer member is not affected at all.

According to the printing apparatus and printing method of the present invention, when each of the toner images is transferred for lamination onto the intermediate transfer member, the surface of the intermediate transfer member is charged in the same polarity as the toner image, instead of being discharged as done hitherto. Therefore the electrostatic attractive force between the toner image transferred on the intermediate transfer member and the intermediate transfer member can be raised to inhibit the reverse transfer of the toner image without using any new device, etc. additionally as an excellent effect of the present invention.

In this case, if a dielectric layer is formed on the surface of the intermediate transfer member, the toner images transferred in lamination can be easily physically removed, to allow better transfer onto the recording medium. In addition, if the dielectric thickness of the surface insulation layer is 5 μm or less, the variation of the surface potential of the intermediate transfer member toward the same polarity as the toner image is suppressed even if charges are accumulated in the surface of the intermediate transfer member. As a result, when the surface of the intermediate transfer member is charged, the transferability of the toner image from the latent image bearing member onto the intermediate transfer member is also enhanced as another effect.

In a preferable embodiment of the printing apparatus of the present invention, the developing means develops a latent image on the latent image bearing member by developer liquid, and a removing means for removing excess developer liquid from the latent image bearing member with the latent image developed is provided. In addition, the developing means and/or the removing means has a member to have an induced potential by the latent image bearing member, and is grounded through a capacitor.

In a preferable embodiment of the printing method of the present invention, a toner image developed on a latent image bearing member is recorded onto a recording medium using a printing apparatus provided with a developing means for developing latent image on the latent image bearing member using developer liquid and with a removing means for removing excess developer liquid from the latent image bearing member with the latent image developed, and the variation of the potential induced in the developing means and/or the removing means by the latent image bearing member is suppressed. More preferably, the developing means uses the reversal development method.

In this embodiment, the developing means and/or the removing means, the variation of potential induced by the electrostatic latent images on the latent image bearing member with various surface potentials attributable to the differences in printing information density is suppressed by the capacitor. In this case, if the electrostatic latent images are developed according to the reversal development method, the effect of suppressing the variation of potential induced can be ideally exhibited.

According to the printing apparatus and printing method of the present invention in this embodiment, the variation of bias voltage induced by the self bias effect can be suppressed, to decrease the deterioration of image quality caused by voltage variation.

In the printing method of the present invention in this embodiment, if the electrostatic latent images are developed by the reversal development method, the effect of suppressing the variation of induced bias voltage can be further more ideally exhibited.

Furthermore, in another preferable embodiment of the printing apparatus of the present invention, the developing means develops a latent image on the latent image bearing member by developer liquid, and plural removing means are provided to remove excess developer liquid from the latent image bearing member with the latent image developed, and the plural removing means are electrically short-circuited. More preferably, the electrically short-circuited plural removing means are held to electrically float. Further more preferably, the plural removing means are grounded through a capacitor.

Moreover, in another preferable embodiment of the printing method of the present invention, the latent image on the latent image bearing member is developed using developer liquid, and plural removing means kept at the same potential are used to remove excess developer liquid from the latent image bearing member after development of the latent image.

In this embodiment, with attention paid to the electrostatic latent image on the latent image bearing member, even if there are portions extremely large in the absolute value of surface potential due to small printing information volume and portions small and close to zero in the absolute value of surface potential due to large printing information volume, the electric short-circuit of the plural removing means averages the induced bias voltages, to stabilize the potential variation.

In this case, if the electrically short-circuited plural removing means are held to electrically float or if the plural removing means are grounded through a capacitor, the variation of induced bias voltages can be more ideally suppressed. According to the printing apparatus and printing method of the present invention in this embodiment, between the plural removing means for removing excess developer liquid from the latent image bearing member, the variation of bias voltage induced by the self bias effect is suppressed, for decreasing the deterioration of image quality caused by the voltage variation.

In this case, if the electrically short-circuited plural removing means are held to electrically float or if the plural means are grounded through a capacitor, the variation of induced bias voltage can be more ideally suppressed, to further improve the image quality obtained.

In a further other preferable embodiment of the printing apparatus of the present invention, the means for developing the electrostatic latent image develops a latent image on the latent image bearing member by a developer liquid, and plural squeeze members for removing excess developer liquid from the latent image bearing member with the latent image developed are arranged along the moving direction of the latent image bearing member in such a manner that the squeeze member on the downstream side in the moving direction of the latent image bearing member is located more closely to the latent image bearing member than the upstream squeeze member on the upstream side.

In a still further other preferable embodiment of the printing apparatus of the present invention, the means for developing the electrostatic latent image develops a latent image on the latent image bearing member by a developer liquid, and plural squeeze members for removing excess developer liquid from the latent image bearing member with the latent image developed are arranged along the moving direction of the latent image bearing member in such a manner that the squeeze member on the downstream side in the moving direction of the latent image bearing member is lower in circumferential speed than the upstream squeeze member on the upstream side.

In a still further other preferable embodiment of the printing method of the present invention, the latent image on the latent image bearing member is developed using developer liquid, and excess developer liquid on the latent image bearing member is removed after development by letting the developer liquid pass through plural gaps sequentially made smaller in the moving direction of the latent image bearing member.

In a still further other preferable embodiment of the printing method of the present invention, the latent image on the latent image bearing member is developed using developer liquid, and excess developer liquid on the latent image bearing member is scraped off after development by letting the developer liquid pass through plural gaps sequentially made smaller in the moving direction of the latent image bearing member, and the scraping-off speed in the passage through the downstream gap is kept lower than that in the passage through the upstream gap. According to the above preferable embodiments of the printing apparatus and printing method of the present invention, if the gaps formed by the squeeze members are changed, the removal by squeezing of the excess developer liquid at the respective gaps can be effected ideally. In this case, if the squeeze members are rotating rollers, the excess developer liquid can be removed stably preferably. Furthermore, if the circumferential speeds of the squeeze rollers are changed, the removal of the excess developer liquid by scraping off at the respective gaps can be ideally effected. Moreover, if the gaps formed by the squeeze rollers and their circumferential speeds are changed respectively, the removal of the excess developer liquid at the respective gaps can be effected more ideally.

In a still further other embodiment of the printing apparatus of the present invention, the developing means develops a latent image on the latent image bearing member with developer liquid, and a developing roller is arranged to keep a clearance against the latent image bearing member, and the developing roller is rotated at a speed to keep the developer liquid in the developing region stable over the full width of the developing roller.

In a still further other embodiment of the printing apparatus of the present invention, the developing means develops latent image on the latent image bearing member with developer liquid, and a developing roller are arranged to keep a clearance against the latent image bearing member, the developing roller having its surface moved in the same direction as the surface of the latent image bearing member, and being rotated at a circumferential speed corresponding to 0.5 to 3 times the circumferential speed of the latent image bearing member. In a still further other embodiment of the printing method of the present invention, a developing region is formed by developer liquid supplied between the latent image bearing member and the developing roller arranged to keep clearance, and in the developing region, the latent image is developed on the latent image bearing member. In this method, the developing roller is rotated for development at a speed to keep the developer liquid in the developing region stable over the full width of the developing roller.

In a still further other embodiment of the printing method of the present invention, a developing region is formed by developer liquid supplied between the latent image bearing member and the developing roller arranged with a clearance kept against it, and in the developing region, the latent image is developed on the latent image bearing member. In this method, the developing roller has its surface moved in the same direction as the surface of the latent image bearing member, and rotated for development with its circumferential speed corresponding to 0.5 to 3 times the circumferential speed of the latent image bearing member.

If the developing roller is rotated under the above condition, the circumferential speed of the developing roller is set appropriately in comparison with the circumferential speed of the photosensitive drum, and it does not happen that the developer liquid becomes wavy or vibrates in the width direction on the surface of the developing region. The circumferential speed as the rotating speed of the developing roller is recommended to be set preferable in a range from 0.5 to 3 times the circumferential speed of the latent image bearing member in view of supplying the developer liquid sufficiently to the latent image bearing member and securing the stability of the developer liquid in the developing region. A more preferable range of the circumferential speed is from 0.6 to 2.5 times, and a further more preferable range is from 0.7 to 2 times. In the above developing method and developing unit, from the viewpoint to prevent unevenness of printing density caused by that the developer liquid supplied by the roller may be blocked by the clearance to become wavy or vibrates in the width direction on the upstream side, the clearance is recommended to be preferably 30 μm or more. On the other hand, the clearance is recommended to be preferably 300 μm or less, from the viewpoint of keeping the developing region stable while preventing the short supply of the developer liquid by the developing roller, and of preventing the image quality deterioration while preventing the occurrence of the so-called edge effect that the printing density rises only at image borders, and also of ideally suppressing the waviness or vibration of the developer liquid in the width direction in the developing region by keeping the balance between the circumferential speed and the clearance of the developing roller. A more preferable range of the clearance is 40 to 250 μm, and a further more preferable range is 50 to 200 μm. If the printing apparatus is provided with an intermediate transfer member to have developed and unfixed images transferred, a paper feeder unit for feeding a recording medium, and a transferring and fixing means for fixing the unfixed images on the intermediate transfer member onto the recording medium, then it can be used for printing not only monochromatic images but also color images.

According to the printing apparatus and printing method of the present invention in this embodiment, since the developing roller is rotated at a proper speed, an image with excellent quality can be formed without lowering the image density and without causing density unevenness.

In this case, if the clearance between the developing roller and the photosensitive drum is set in a range from 30 to 300 μm, the balance between the circumferential speed and the clearance of the developing roller can be secured, and the developing region formed can be homogeneous in the width direction, to provide a sufficient printing density without causing the printing density to be uneven. Furthermore, if the printing apparatus is provided with an intermediate transfer member to have developed and unfixed images transferred, a paper feeder unit for feeding a recording medium, and a transferring and fixing means for fixing the unfixed images on the intermediate transfer member onto the recording medium, then it can be used for printing not only monochromatic images but also color images.

Figure 1:
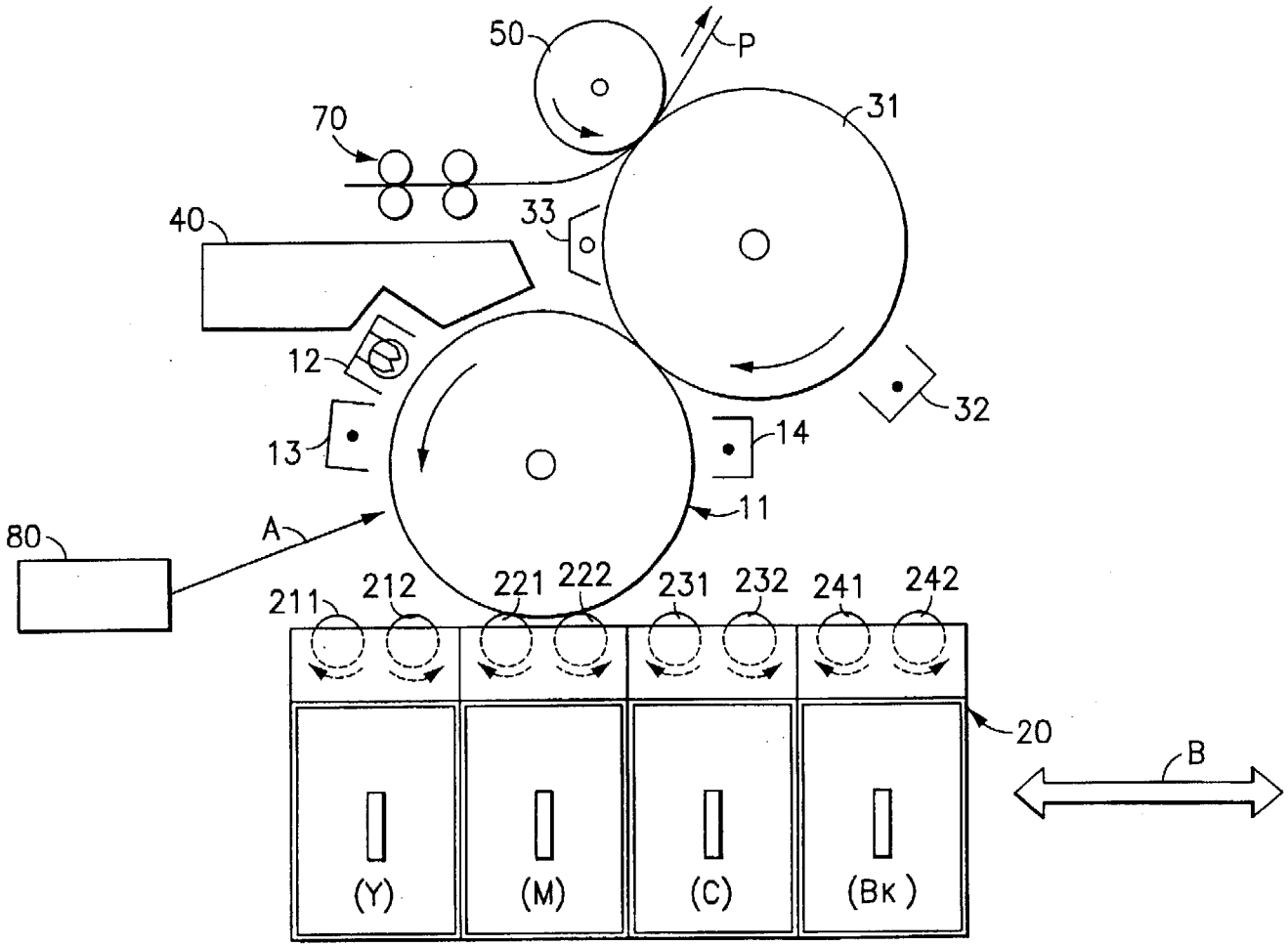
FIG. 1 is a front view showing the major portion of an electrophotographic printer as an example of the printing apparatus and printing method of the present invention.

The respective symbols in the drawings denote the following:

1, 2: electrophotographic printer 3: photosensitive drum
4: photosensitive surface (image carrier)
10: photosensitive means
11: photosensitive drum (latent image bearing member)
12: discharger 13: primary charger 14: pre-transfer charger
20, 20*a*, 20*b*, 20*c*: developing means
21~24: developing unit
25: driving means 26: toner cartridge
30: intermediate transfer means 31: intermediate transfer member
31*a*: metallic drum 31*b*: rubber layer 31*c*: binding layer
31*d*: dielectric layer
32: secondary charger (of intermediate transfer member)
33: heater 40: cleaning means 42: cleaning roller
43: rubber blade 50: transfer means
51, 52: heating roller 53: tension roller 54: fixing belt
60: subsidiary squeeze means 61: subsidiary squeeze roller 62: pan
70: paper feeder unit 70*a*: paper feeder roller
80: exposing means 110: partition 112: developing compartment
114: recovery compartment 118, 124, 126: scraper
120: first squeeze member 122: second squeeze member
130, 136: first squeeze roller 132, 138: second squeeze roller
211, 221, 231, 241: developing roller
212, 222, 232, 242: squeeze roller
Ap: developing region
Lc: point of intersection (with the photosensitive drum)
LT: contact line (between the developing roller and the liquid face of liquid toner)
C: capacitor P: recording medium S: recording paper

BEST MODE FOR CARRYING OUT THE INVENTION

Examples of the present invention are described below in reference to the drawings.

EXAMPLE 1

FIG. 1 shows an electrophotographic printer as an example of the printing apparatus and printing method of the present invention. The electrophotographic printer is provided with a latent image bearing member 11, a primary charger 13, an exposing means 80, a developing means 20, a pre-transfer charger 14, an intermediate transfer member 31, a secondary charger 32, a heat transfer means 50, a cleaning means 40, and a discharger 12, etc. The respective components are composed as described below.

The latent image bearing member 11 is an organic photosensitive drum (a photosensitive drum with an organic photoconductor layer on the surface). A photosensitive drum with a photoconductive layer of selenium or amorphous silicon, etc. on the surface may also be used. A photosensitive belt may also be used instead of the photosensitive drum.

The primary charger 13 uniformly charges the surface of the latent image bearing member 11 by a corona charger. Instead of the corona charger, a contact charger using a conductive roller may also be used.

The exposing means 80 is a laser optical system, and irradiates the surface of the latent image bearing member 11 with the light corresponding to the color image information, for forming electrostatic latent images one after another. The exposing means may also be an LED optical system, etc. The arrow A in the drawing indicates the position exposed to the light from the exposing means 80.

The developing means 20 is a liquid developing apparatus using the known roller developing method, and consists of four independent developing units containing liquid toner of yellow, magenta, cyan or black respectively, and can be moved in the direction of arrow B by a moving means not illustrated. The number of the developing units may also be two for black and magenta, for example, or three for yellow, magenta and cyan, or furthermore five or more including other colors. The four developing units are provided with a developing roller 211, 221, 231 or 241 respectively with its bottom immersed in the liquid toner and a squeeze roller 212, 222, 232 or 242 respectively for removing excess liquid toner adhering to the latent image bearing member 11 during development. Carrier liquid with toner particles dispersed therein is used as each of the liquid toner. The pre-transfer charger 14 is a corona charger and charges the surface of the latent image bearing member 11 together with the developed toner image in the same electric polarity as the toner image. The pre-transfer charging causes the toner image to be pressed by the electrical field force, to increase the attractive force between the latent image bearing member 11 and the toner image, for suppressing the flow and thickening of the toner image when the toner image is transferred onto the intermediate transfer member 31. At the same time, the surface of the latent image bearing member 11 is charged in the same polarity as the toner image, and as a result, acts also as a bias for transfer onto the intermediate transfer member.

Figure 2:
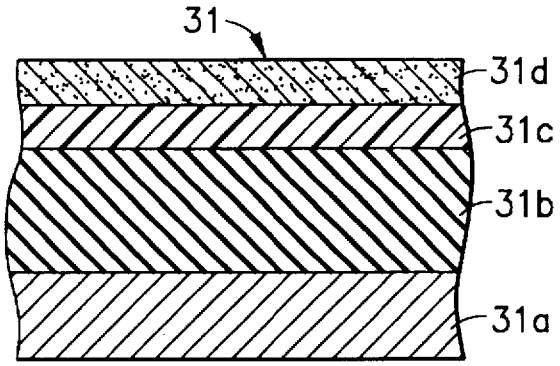
FIG. 2 is a sectional view for partially showing the structure of an intermediate transfer member.

The intermediate transfer member 31 has, as shown in FIG. 2, a conductive rubber layer 31*b*, a binding layer 31*c* made of an insulating material and a dielectric layer 31*d* laminated sequentially on a metallic drum 31*a* made of aluminum or stainless steel, etc. The rubber layer 31*b* is a layer for improving the close contact with the latent image bearing member 11, and the material is not especially limited as far as the intended function may be exhibited. The material of the rubber layer 31*b* may be selected, for example, from fluorine rubber, silicone rubber, ethylene propylene rubber, nitrile rubber, butyl rubber, acrylic rubber, etc. The material of the dielectric layer 31*d* as the surface layer is not especially limited as far as the transferability of the color toner images transferred in lamination onto the recording medium such as recording paper is good, and may be selected, for example, from a material such as silicone, tetrafluoroethylene, vinylidene fluoride, etc. The intermediate transfer member 31 has a bias voltage reverse in polarity to the toner particles applied by an applying means (not illustrated) for applying a transfer bias. The intermediate transfer member 31 may be of any proper diameter, depending on the size of the recording medium. The intermediate transfer member 31 may also be a transfer belt, instead of a roller. If the rubber layer 31*b* highly adheres to the dielectric layer 31*d*, the binding layer 31*c* is not necessarily required. In this example, the surface insulation layer consists, for example, of a dielectric layer 31*d* (3 μm thick) made of silicone rubber (3 in dielectric constant) and a binding layer (1 μm thick) of 4 in dielectric constant. The dielectric thickness in this case is 1.25 μm.

The secondary charger 32 uniformly charges the surface of the intermediate transfer member 31 in the same polarity as the transferred toner image whenever each of the toner images is transferred from the latent image bearing member 11 onto the intermediate transfer member 31, and is, for example, a corona charger. If the dielectric thickness of the surface insulation layer of the intermediate transfer member 31 is kept at 5 μm or less, the surface potential does not vary greatly even if the charges by the charging are accumulated in the surface of the dielectric layer 31*d*. Furthermore, if Scorotron-type corona charger with a grid is used as the secondary charger 32, the rise of the surface potential of the intermediate transfer member 31 can be preferably further suppressed by controlling the grid voltage. Moreover, since the surface of the latent image bearing member 11 is charged in the same polarity as the toner images by the pre-transfer charger 14, repulsive force acts between the surface and the toner images, to further suppress the reverse transfer.

The heat transfer means 50 is a roller containing a heater (not illustrated), and is pressed against the intermediate transfer member 31 by a pressure mechanism (not illustrated), to heat and pressurize the color toner images transferred in lamination on the intermediate transfer member 31, for transferring them onto the recording medium P.

The pressure mechanism keeps the heat transfer means 50 away from the intermediate transfer member 31 when the toner images are transferred from the latent image bearing member 11 onto the intermediate transfer member 31. Till the portion where the last one of the four toner images transferred exists on the intermediate transfer member 31 is reached, the pressure mechanism keeps the heat transfer means 50 pressed against the intermediate transfer member 31 at a predetermined pressure. Thus, the heat transfer means 50 heats and pressurizes the color toner images transferred in lamination on the intermediate transfer member 31, for transferring the four toner images all at once onto the recording medium P fed from a paper feeder unit 70. The cleaning means 40 has a sponge roller (not illustrated) and a cleaning blade (not illustrated) in a cartridge, and if the cartridge is mounted in the electrophotographic printer, the sponge roller and the cleaning blade contact the latent image bearing member 11. The cleaning means 40 scrapes off the toner image and liquid toner remaining on the latent image bearing member 11 by the sponge roller and the cleaning blade after completion of transfer of each toner image. Thus, the latent image bearing member 11 is cleaned.

The discharger 12 irradiates the latent image bearing member 11 on the full surface with a tungsten lamp or LED array, etc., for removing the charges remaining on the latent image bearing member 11.

In FIG. 1, symbol 33 denotes a heater for preliminarily heating the color toner images to be transferred onto the recording medium P, for improving their transferability.

The electrophotographic printer composed as described above produces a color image according to the following printing method.

In the electrophotographic printer, at first the latent image bearing member 11 is rotated in the direction of arrow in the drawing, and is uniformly charged on the surface by the primary charger 13.

Then, the image information of yellow to be made visible at first is written into the latent image bearing member 11 by the exposing means 80.

The electrostatic latent image thus obtained is developed by the yellow liquid toner in the developing unit of the developing means 20. For development, the developing roller 211 with its bottom immersed in the yellow liquid toner is rotated, to supply the liquid toner to the latent image bearing member 11. Excess liquid toner adhering to the latent image bearing member 11 by this development is removed by the squeeze roller 212. The developing rollers 221, 231 and 241, and the squeeze rollers 222, 232 and 242 in the developing units containing liquid toner of any other color respectively also act similarly when the corresponding developing unit is used for development action.

Subsequently, the pre-transfer charger 14 charges the surface of the electrostatic latent image bearing member 11 together with the developed yellow toner image. The charging increases the electrostatic attractive force of the toner image toward the latent image bearing member 11, for suppressing the flow and thickening of the image when the toner image is transferred onto the intermediate transfer member 31.

The yellow toner image obtained is transferred onto the intermediate transfer member 31 by applying a transfer bias voltage reverse in polarity to the charges of the toner image from the back of the intermediate transfer member 31. Thus, the yellow toner image is transferred onto the intermediate transfer member 31, and the secondary charger 32 uniformly charges the surface of the intermediate transfer member 31 to be the same in polarity as the transferred toner image. This charging treatment enhances the electrostatic attractive force between the yellow toner image transferred onto the intermediate transfer member 31 and the intermediate transfer member 31, to decrease the reverse transfer when the next magenta toner image is transferred.

In addition, in the intermediate transfer member 31, if the dielectric thickness of the surface insulation layer consisting of the binding layer 31*c* and the dielectric layer 31*d* is 5 μm or less, the variation of the surface potential is suppressed even if charges are accumulated in the dielectric layer 31*d*. As a result, the reverse transfer of the yellow toner image is further suppressed, and the transferability of the magenta toner image from the latent image bearing member 11 to the intermediate transfer member 31 is enhanced.

The latent image bearing member 11 remaining after the yellow toner image has been transferred onto the intermediate transfer member 31 has the liquid toner remaining on the surface and the residual charges removed by the cleaning means 40 and the discharger 12.

In succession, the latent image bearing member 11 is uniformly charged again on the surface by the primary charger 13, and the image information of magenta to be made visible next is written.

The electrostatic latent magenta image thus obtained is developed by the developing unit containing the magenta liquid toner of the developing means 20, and the latent image bearing member 11 has excess liquid toner removed and then charged by the pre-transfer charger 14.

The magenta toner image obtained on the latent image bearing member 11 is transferred in lamination onto the intermediate transfer member 31 where the yellow toner image exists already. In the same process, the intermediate transfer member 31 gets the cyan toner image transferred for lamination, and finally the black toner image is transferred for lamination. In this case, when the respective toner images are transferred in lamination onto the intermediate transfer member 31, overlap registration is effected needless to say.

After the four color toner images have been formed in lamination on the intermediate transfer member 31 in this way, the heat transfer means 50 is pressed against the intermediate transfer member 31 by said pressure mechanism, while the recording medium P fed from the paper feeder unit 70 is held between the heat transfer means 50 and the intermediate transfer member 31, for getting the laminated color toner images transferred onto the recording medium P.

The method of the present invention of transferring the toner images from the latent image bearing member 11 onto the intermediate transfer member 31 while uniformly charging the surface of the intermediate transfer member 31 in the same polarity as the transferred toner images is compared below with the conventional method of discharging the surface of the intermediate transfer member.

For comparison, three color toner images of yellow 100%, magenta 100% and cyan 100% were overlapped to print the process black by the respective methods, and the reflection densities were measured while any unevenness, etc. were visually observed. The dielectric thickness of the surface insulation layer in the intermediate transfer member 31 was 1.25 μm in the layer composition described before.

As a result, the process black printed according to the method of the present invention was 1.8 in reflection density, and free from any unevenness, but the process black printed by the conventional method was poor in color overlapping and uneven, being 0.4 in reflection density, and could not be called black, but yellowish brown.

With the thickness of the binding layer 31*c* kept fixed, the dielectric thickness of the dielectric layer 31*d* in the surface of the intermediate transfer member 31 was changed, to measure the transfer rate according to the following procedure.

That is, while a toner image was transferred from the latent image bearing member 11 onto the intermediate transfer member 31, the electrophotographic printer was stopped, and the toner image on the intermediate transfer member 31 and the toner image remaining on the latent image bearing member 11 immediately after transfer were dried by hot air respectively. Then, the respective toner images on the latent image bearing member 11 and the intermediate transfer member 31 were peeled by an adhesive tape, and stuck to white paper, to measure the respective toner images by a reflection densitometer.

The transfer rate was calculated from a/(a+b), where a is the density of the toner image on the intermediate transfer member 31 and b is the density of the toner image remaining on the latent image bearing member 11 immediately after transfer. As a result, the transfer rate of the toner image in the case of magenta was 85% when the dielectric thickness of the surface insulation layer of the intermediate transfer member 31 was 3 μm, 70% when 5 μm, and less than 50% when more than 10 μm. As described before, in the printing method of the present invention, it was found that good toner images can be obtained without affecting the formation of the toner images in lamination on the intermediate transfer member 31. Preferably, a good transfer rate could be obtained if the dielectric thickness of the surface insulation layer of the intermediate transfer member 31 is 5 μm or less.

EXAMPLE 2

Figure 4:
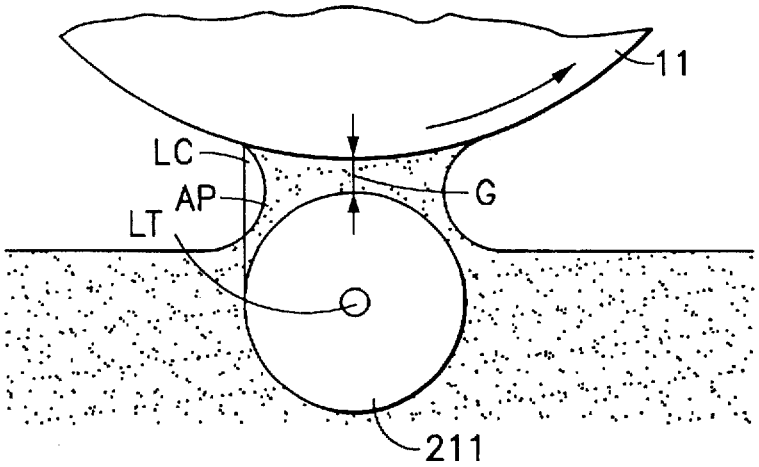
FIG. 4 is a front view showing the arrangement of the developing roller and the photosensitive drum in the printing apparatus and printing method of FIG. 3.
Figure 3:
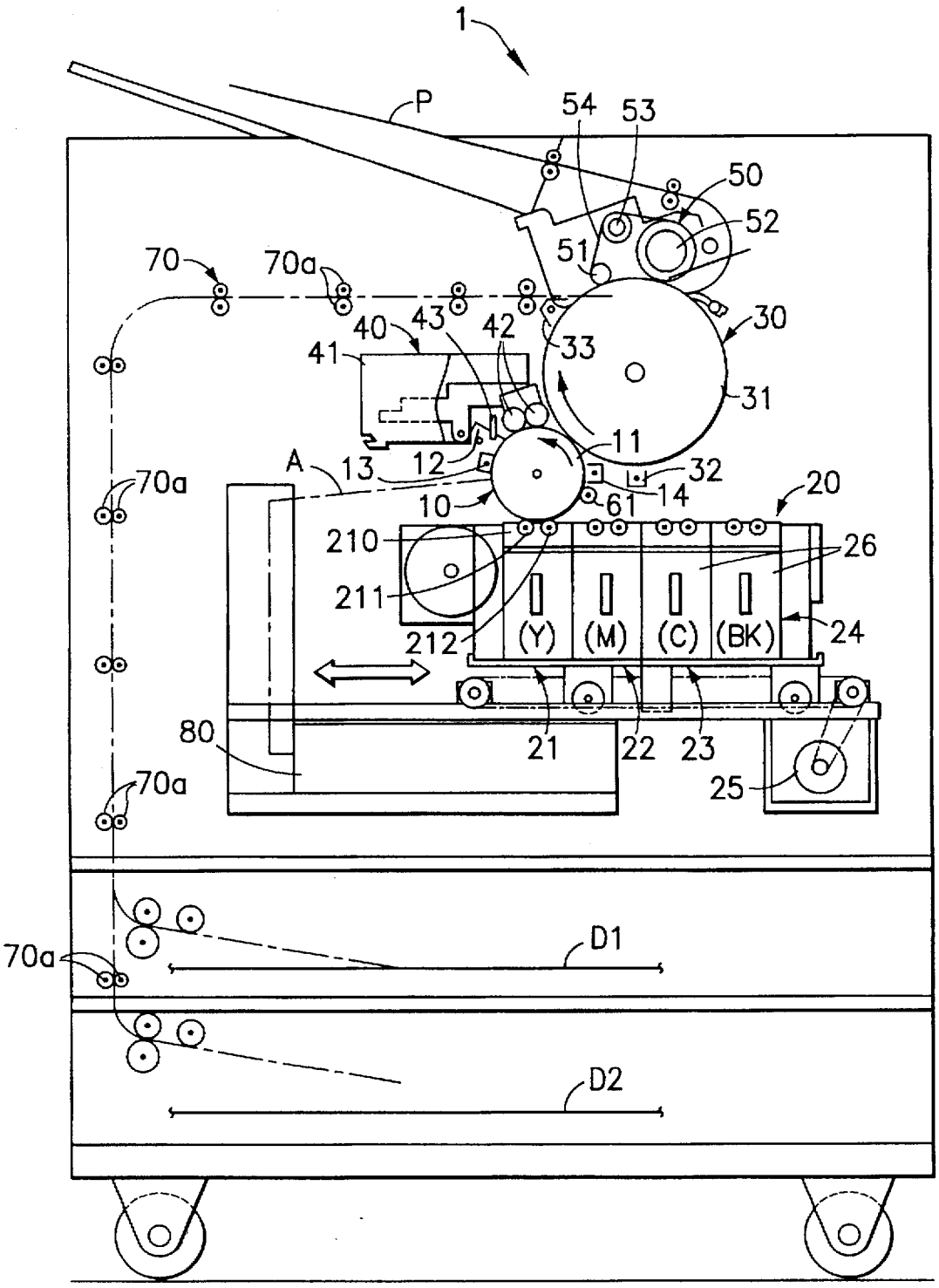
FIG. 3 is a front view showing an electrophotographic printer as another example of the printing apparatus and printing method of the present invention.

Another example of the printing apparatus and printing method of the present invention is described below in detail in reference to FIGS. 3 and 4 showing an electrophotographic printer for color printing.

The electrophotographic printer 1 is, as shown in FIG. 3, provided with a photosensitive means 10, a developing means 20, an intermediate transfer means 30, a cleaning means 40, a transfer means 50, a subsidiary squeeze roller 61, a paper feeder unit 70 of a recording medium (recording paper) P, and an exposing means 80 for light irradiation in the direction of arrow A.

The electrophotographic printer 1 shown in FIG. 3 is viewed in front, and in the following description, the illustrated side is called the front side, while the side corresponding to the back of the drawing is called the rear side. The respective arrows shown in FIG. 3 indicate the rotating directions of respective means and the feed direction of the recording medium P.

The photosensitive means 10 has a photosensitive drum 11, a discharger 12 for removing the residual charges of the photosensitive drum 11, and a primary charger 13 for uniformly charging the photosensitive drum 11, and the photosensitive drum 11 has its surface cleaned by the cleaning means prior to the removal of residual charges.

The photosensitive drum 11 has a photosensitive layer made of an organic photoconductor (OPC) formed on the surface of a cylindrical drum. The material of the photosensitive layer may be an organic optical photoconductor, or also a selenium (Se) based material or amorphous silicon (α-Si), etc. The discharger 12 is an LED array or small incandescent lamp, and makes the photosensitive drum irradiated on the surface with light, to erase the residual latent image. The primary charger 13 uniformly charges the photosensitive drum 11 by the ions generated by corona discharge.

The developing means 20 is provided with a first developing unit 21 through a fourth developing unit 24, a driving means 25 for integrally moving the developing units 21 through 24 horizontally in both the directions indicated by the arrows in the drawing in the tangential direction of the photosensitive drum 11, and toner cartridges 26 detachably mounted in the respective developing units 21 through 24.

In the developing means 20, the respective developing units 21 through 24 are provided with one of the toner cartridges 26 respectively containing a liquid toner of yellow, magenta, cyan or black. In the initial position before start of development, they are located on the right of the photosensitive drum 11. The developing units 21 through 24 are sequentially moved for development in this order by the driving means 25 toward the photosensitive means 10, to develop, one after another, the respective electrostatic latent images formed based on color separated print information. Each of the liquid toner used is prepared by dispersing toner particles of yellow, magenta or cyan, etc. into a liquid carrier.

The first developing unit 21 has a liquid tank 210 of the liquid toner at the top, and the toner cartridge 26 containing the liquid toner of the corresponding color at the bottom. The liquid tank 210 is provided with a developing roller 211 and a squeeze roller 212 arranged in parallel with a predetermined distance kept between them.

The developing roller 211 feeds the liquid toner in the liquid tank 210 to the photosensitive drum 11 by the flow accompanying its rotation, to develop the electrostatic latent image formed on the photosensitive drum 11. The developing roller 211 is provided to face the photosensitive drum 11, as shown in FIG. 4, with a gap G of 30 to 300 μm kept between them. Furthermore, between the photosensitive drum 11 and the developing roller 211, a developing region AP is formed over the full width of the photosensitive drum 11, and the electrostatic latent image is developed in the developing region AP. To the developing roller 211, usually a developing bias voltage of about −200 to −600 V is applied. The liquid tank 210 is fed with the liquid toner from the toner cartridge 26 provided in the developing unit 21.

Since the other developing units 22 to 24 are composed like the first developing unit 21, the detailed explanation is not repeated here.

The liquid toner is supplied from the toner cartridge 26 to the developing unit 21 only when the photographic printer 1 is used, and usually the liquid toner is not contained in the liquid tank 210 of the developing unit 21.

The intermediate transfer means 30 is provided with an intermediate transfer member 31, and a secondary charger 32 arranged in the rotating direction of the intermediate transfer member 31.

The intermediate transfer member 31 has, as shown in FIG. 2, a conductive rubber layer **31*b*, a binding layer 31*c* made of an insulating material and a dielectric layer 31*d* formed in this order in lamination on a metallic drum 31*a* made of aluminum or stainless steel, etc. The rubber layer 31*b* is a layer for improving the close contact with the latent image bearing member 11, and the material is not especially limited as far as the function may be exhibited. The material of the rubber layer 31*b* may be selected, for example, from fluorine rubber, silicone rubber, ethylene propylene rubber, nitrile rubber, butyl rubber, acrylic rubber, etc. Furthermore, the material of the dielectric layer 31*d*** as the surface layer is not especially limited as far as the transferability of the color toner images transferred in lamination onto the recording medium such as recording paper is good, and may be selected, for example, from dielectrics such as silicone, tetrafluoroethylene and vinylidene fluoride.

The secondary charger 32 charges the intermediate transfer member 31 according to the same principle as that of the primary charger 13, to erase the influence of the previous toner image for allowing the next toner image different in color to be easily transferred from the photosensitive drum 11, and to prevent the toner image already transferred on the intermediate transfer member 31 from being returned onto the photosensitive drum 11. The charger may be, for example, a corona charger. Even if the charging treatment is effected, it does not happen that charges are accumulated in the surface insulation layer, and they are mainly accumulated in the toner image to increase the quantity of charges owned by the toner image preferably if the dielectric thickness of the surface insulation layer of the intermediate transfer member 31 is kept at 5 μm or less. If a Scorotron-type corona charger with a grid is used as the secondary charger 32, the rise of the surface potential of the intermediate transfer member 31 can be further suppressed preferably by controlling the grid voltage. Moreover, since the surface of the latent image bearing member 11 is charged in the same polarity as the toner image by the pre-transfer charger 14, repulsive force acts between the surface of the latent image bearing member 11 and the toner image, to further suppress the reverse transfer.

In the intermediate transfer means 30, the toner images developed by the photosensitive drum 11 are transferred in lamination onto the intermediate transfer member 31 one after another while being charged by the secondary charger 32. In this transfer, the toner image or the liquid toner which has not been transferred onto the intermediate transfer member 31 remains slightly on the photosensitive drum 11, and they are cleaned by the cleaning means 40.

Heater 33 is a heater utilizing halogen lamp or infra-red ray lamp, etc., for heating the intermediate transfer member 31. In the intermediate transfer means 30, the toner images developed by the photosensitive drum 11 are transferred in lamination onto the intermediate transfer member 31 one after another while being charged by the secondary charger 32. In this transfer, the toner image or the developer liquid which has not been transferred onto the intermediate transfer member 31 remains slightly on the photosensitive drum 11, and they are cleaned by the cleaning means 40.

The compositions and actions of the intermediate transfer member 31 and the secondary charger 14 are as described in detail in Example 1.

The cleaning means 40 collects the residues of the toner image and the liquid toner on the photosensitive drum 11 after transfer of the toner image onto the intermediate transfer member 31, and has a sponge cleaning roller 42 and a rubber blade 43 in contact with the photosensitive drum 11. The transfer means 50 has heating rollers 51 and 52, a tension roller 53 and an endless fixing belt 54.

The heating rollers 51 and 52 are rollers containing a heater (not illustrated) such as a halogen lamp for heating the fixing belt 54. As shown in FIG. 3, the heating roller 51 on the upstream side in the feed direction of the recording paper P and the heating roller 52 on the downstream side are arranged respectively in contact with the intermediate transfer member 31. The heating rollers 51 and 52 are driven integrally with the tension roller 53 by a pressure mechanism not illustrated, when the multi-color toner image is heated and fixed onto the recording paper P, and the fixing belt 54 is kept in pressure contact with the intermediate transfer member 31, to heat and press the multi-color toner image transferred in lamination on the intermediate transfer member 31, for fixing onto the recording paper P.

The tension roller 53 is arranged in parallel to the intermediate transfer member 31, with its angle against the intermediate transfer member 31 kept adjustable, to give tension to the fixing belt 54, and if its angle against the intermediate transfer member 31 is adjusted, the position of the recording paper P in the width direction can be corrected to prevent swaying.

The fixing belt 54 is a thin metallic belt made of nickel or stainless steel or a silicone rubber belt wound around the heating rollers 51 and 52 and the tension roller 53.

The pressure mechanism is kept away from the intermediate transfer member 31 together with the heating rollers 51 and 52 and the fixing belt 54 when the toner images are transferred from the photosensitive drum 11 onto the intermediate transfer member 31. Till the portion where the last one of the four toner images transferred exists on the intermediate transfer member 31 is reached, the heating rolls 51 and 52 are pressed against the intermediate transfer member 31 together with the fixing belt 54 at a predetermined pressure by the pressure mechanism. In this way, the fixing belt 54 heats and pressurizes the multi-color toner image transferred in lamination on the intermediate transfer member 31, for transferring and fixing it onto the recording paper P fed by the paper feeder unit 70.

The subsidiary squeeze roller 61 is provided between the developing means 20 and the intermediate transfer means 30, and is rotated in the same direction as the photosensitive drum 11, to remove excess liquid toner, especially liquid carrier transferred in excess of the gap from the photosensitive drum 11 with the toner image developed.

The paper feeder unit 70 is provided with plural rollers 70*a* for feeding the recording paper P drawn out of either of sheet drawers D1 and D2 located with one on the other, to the intermediate transfer member 31.

The exposing means 80 is a laser optical system for forming the electrostatic latent images based on color-separated print information on the surface of the photosensitive drum 11, and has a laser beam source, liquid crystal shutter, etc., and irradiates with a laser beam onto the photosensitive drum 11 in the direction of arrow A based on the print information corresponding to the respective colors of a color original, and forms the electrostatic latent images corresponding to the respective print information on the surface.

The electrophotographic printer 1 of the present invention composed as described above prints a color image as described below.

At first, from the surface of the photosensitive drum 11 cleaned by the cleaning means 40, the residual charges are removed by the discharger 12, and the photosensitive drum 11 is uniformly charged by the primary charger 13.

Then, the exposing means 80 irradiates with a laser beam as shown by the arrow A of FIG. 3, to form the electrostatic latent images one after another based on the color-separated print information on the surface of the photosensitive drum 11. In this case, four electrostatic latent images corresponding to yellow, magenta, cyan and black colors are formed by the laser beam irradiation.

Subsequently, the developing means 20 provided on the right of the photosensitive drum 11 in FIG. 3 is moved horizontally toward the photosensitive drum 11 by the driving means 25, to develop the yellow toner image by the first developing unit 21, the magenta toner image by the second developing unit 22, and similarly the cyan and black toner images one after another. The toner images developed by the respective developing units in this way are transferred onto the intermediate transfer member 31 one after another, to form a multi-color toner image with four toner images laminated on the intermediate transfer member 31.

Concurrently with or after completion of the transfer of the toner image developed by the fourth developing unit 24 onto the intermediate transfer member 31, the fixing belt 54 is pressed against the intermediate transfer member 31 by the pressure mechanism, to heat and pressurize the multi-color toner image formed in lamination on the intermediate transfer member 31, for transferring and fixing it all at once onto the recording paper P, thus completing the recording of the color image. If the recording of the multi-color toner image onto the recording paper P is completed, the pressure contact of the fixing belt 54 with the intermediate transfer member 31 achieved by the pressure mechanism is released, and the photosensitive drum 11 is moved rightward to its initial position by the driving means 25.

In this case, each of the developing rollers, for example, the developing roller 211 of the developing unit 21 is rotated at a speed to keep the liquid toner stable over the full width of the developing roller 211, without causing the liquid toner to be wavy or vibrate in the width direction on the surface of the developing region AP. The rotating speed of the developing roller 211, in the gap G, in this case is such that its circumferential speed is approximately 0.5 to 3 times the circumferential speed of the photosensitive drum 11 while the roller surface moves in the same direction as the surface of the photosensitive drum 11.

When the developing roller 211 is rotated at any circumferential speed in this range, as shown in FIG. 4, the rear end of the photosensitive drum 11 in the rotating direction in the developing region AP is located downstream of the point of intersection LC between the photosensitive drum 11 and the vertical line extending upward from the upstream side circumferential edge LT of the developing roller 211.

Therefore, in the electrophotographic printer 1, the circumferential speed of the developing rollers of the respective developing units is set appropriately in comparison with the circumferential speed of the photosensitive drum 11, and it does not happen that the liquid toner becomes wavy or vibrate in the width direction on the surface of the developing region AP. So, in the electrophotographic printer 1, the liquid toner is stable in the developing region AP, to give a high quality image free from density unevenness.

The action of the secondary charger 32 when laminating the toner images of the respective colors onto the intermediate transfer member is described below in detail. The yellow image information to be made visible at first is written onto the latent image bearing member 11 by the exposing means 80.

The electrostatic latent image thus obtained is developed by the yellow liquid toner by the developing unit of the developing means 20. For development, the developing roller 211 with its bottom immersed in the yellow liquid toner is rotated, to supply the liquid toner to the latent image bearing member 11. Excess liquid toner adhering to the latent image bearing member 11 by this development is removed by the squeeze roller 212. The developing rollers 221, 231 and 241 and the squeeze rollers 222, 232 and 242 installed in the developing units containing any of the other color liquid toners also act similarly for development of the respective colors.

Then, the pre-transfer charger 14 charges the surface of the electrostatic latent image bearing member 11 together with the developed yellow toner image. This charging increases the electrostatic attractive force of the toner image toward the latent image bearing member 11, for suppressing the flow and thickening of the image when the toner image is transferred onto the intermediate transfer member 31. At the same time, the surface of the latent image bearing member 11 is charged in the same polarity as the toner image, also to act as a bias for transfer onto the intermediate transfer member.

The yellow toner image obtained is transferred onto the intermediate transfer member 31, by applying a transfer bias voltage reverse in polarity to the charges of the toner image from the back of the intermediate transfer member 31. If the yellow toner image is transferred onto the intermediate transfer member 31 in this way, the surface of the intermediate transfer member 31 is uniformly charged in the same polarity as the transferred toner image by the secondary charger 32.

The charging treatment increases the electrostatic attractive force between the yellow toner image transferred on the intermediate transfer member 31 and the intermediate transfer member 31, to decrease the reverse transfer when the next magenta toner image is transferred.

In addition, if the intermediate transfer member 31 is 5 μm or less in the dielectric thickness of the surface insulation layer consisting of the binding layer 31*c* and the dielectric layer 31*d*, few charges are accumulated in the surface insulation layer, to suppress the rise of the surface potential of the intermediate transfer member 31. As a result, the amount of charges of the yellow toner image increases, to further suppress the reverse transfer, and also to enhance the transferability of the magenta toner image from the latent image bearing member 11 onto the intermediate transfer member 31.

The present invention may also be applied to a color photo copier using the light reflected from a color original as the print information.

EXAMPLE 3

Figure 5:
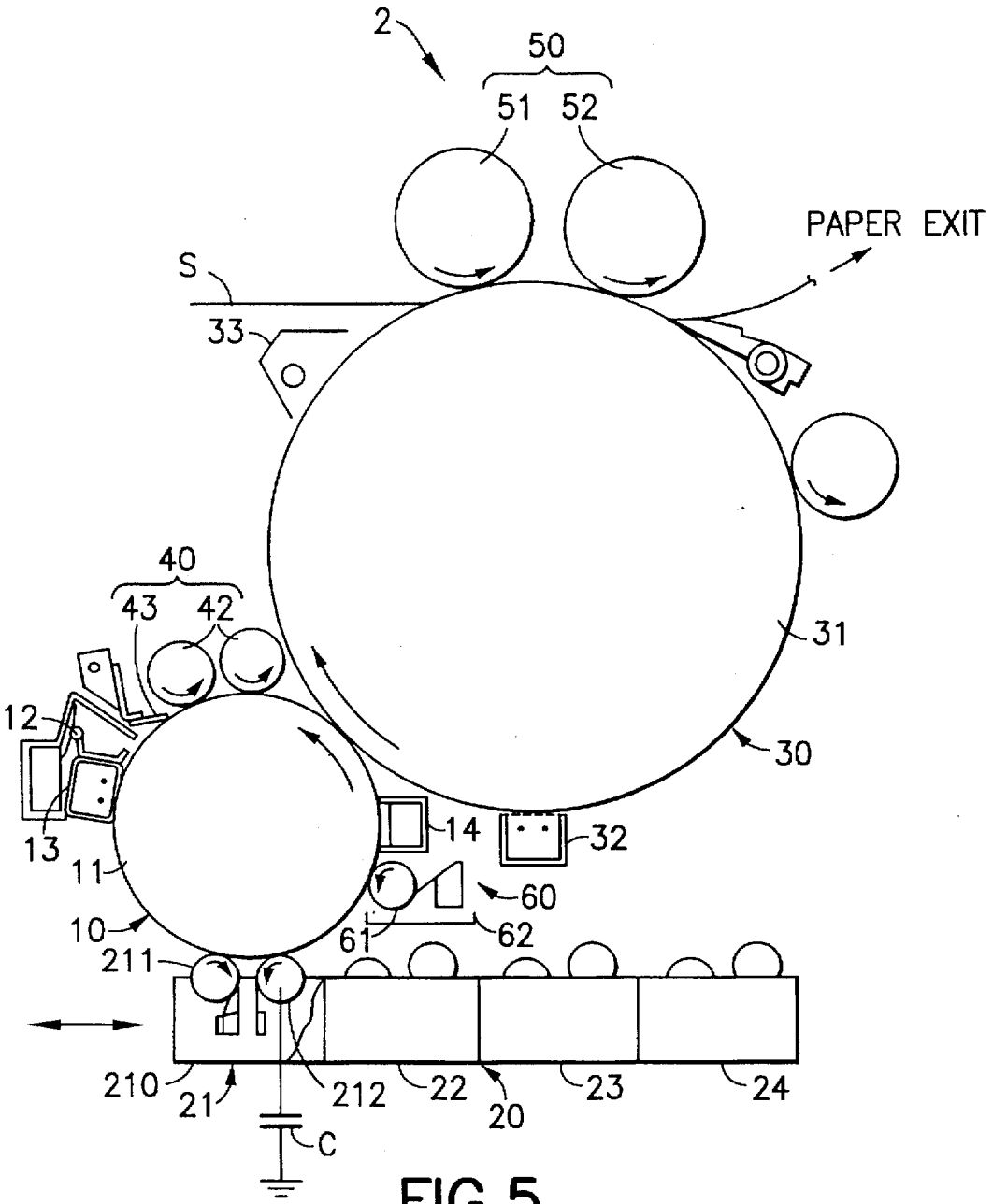
FIG. 5 is a front view showing the major portion of an electrophotographic printer as a further other example of the printing apparatus and printing method of the present invention.

A further other example of the printing apparatus and printing method of the present invention is described below in detail in reference to FIG. 5 showing an electrophotographic printer based on the reversal development for color printing. An electrophotographic printer 2 is, as shown in FIG. 5, provided with a photosensitive means 10, a developing means 20, an intermediate transfer means 30, a cleaning means 40, a transferring and fixing means 50, a pre-transfer charger 14 and a subsidiary squeezing means 60, and the photosensitive means 10 is irradiated with light by an exposing means (not illustrated).

The photosensitive means 10 has a photosensitive drum 11, a discharger 12 and a primary charger 13, and the photosensitive drum 11 is cleaned on the surface by the cleaning means 40 prior to the removal of residual charges.

The photosensitive drum 11 has a photosensitive layer made of an organic photoconductor formed on the surface of a cylindrical drum, and electrostatic latent images are formed on it by the light emitted from said exposing means. The discharger 12 is a small incandescent lamp for irradiating the surface of the photosensitive drum 11 with light for removing the residual charges. The primary charger 13 is a corona charger for uniformly charging the surface of the photosensitive drum 11 by the ions generated by corona discharge.

The developing means 20 has a first developing unit 21 through a fourth developing unit 24, and is integrally moved horizontally in both the directions indicated by the arrows in the drawing in the tangential direction of the photosensitive drum 11. In each of the respective developing units, a toner cartridge containing developer liquid of yellow, magenta or cyan, etc. but not illustrated is detachably installed. The developer liquid is obtained by dispersing toner particles of yellow, magenta or cyan, etc. into a liquid carrier.

In the first developing unit 21, a developing roller 21*b* and a squeeze roller 212 are arranged in parallel to each other with a predetermined clearance kept between them in a liquid tank 21*a* for a developer liquid. The liquid tank 21*a* gets a developer liquid supplied from the toner cartridge provided in the developing unit 21.

The squeeze roller 212 is a metallic roller or has a thin film made of an insulating synthetic resin or ceramic, etc. on the surface of a metallic roller, and is grounded through a capacitor C as illustrated.

The other developing units 22 to 24 are composed like the first developing unit 21, and so their detailed explanation is not repeated here.

The developing means 20 is located on the right of the photosensitive drum 11 in the initial position before start of development. The developing units 21 through 24 are sequentially moved in this order toward the photosensitive means 10 by said driving means, and respective electrostatic latent images formed based on color-separated print information are developed one after another.

The respective developer liquid is supplied to the respective developing units from the respective toner cartridges only when the electrophotographic printer 2 is used, and are usually not contained in the liquid tanks of the developing units. The intermediate transfer means 30 is provided with an intermediate transfer member 31, a secondary charger 32 and a heater 33.

The intermediate transfer member 31 is pressed against the photosensitive drum 11, and after the toner image of each color is developed by the corresponding one of the developing units 21 through 24 of the developing means 20, the toner image is transferred for sequential lamination.

The secondary charger 32 charges the intermediate transfer member 31 in the same principle as that of the primary charger 13 of the photosensitive means 10, to erase the influence of the previous toner image for easier transfer of the next toner image different in color from the photosensitive drum 11, for preventing that the toner image already transferred on the intermediate transfer member 31 returns to the photosensitive drum 11. Furthermore, since the surface of the latent image bearing member 11 is charged in the same polarity as the toner image by the pre-transfer charger 14, repulsive force acts between the latent image bearing member 11 and the toner image, for further suppressing the reverse transfer.

The heater 33 is a heater utilizing halogen lamp or infrared lamp, etc., for heating the intermediate transfer member 31. In the intermediate transfer means 30, the toner images developed by the photosensitive drum 11 are transferred in lamination onto the intermediate transfer member 31 one after another while being charged by the secondary charger 32. In the transfer, the toner image or the developer liquid which has not been transferred onto the intermediate transfer member 31 remains slightly on the photosensitive drum 11, and they are cleaned by the cleaning means 40. The compositions and actions of the intermediate transfer member 31 and the secondary charger 14 are as described in detail in Example 1.

The cleaning means 40 collects the residues of the toner image and the developer liquid on the photosensitive drum 11 after transfer of the toner images onto the intermediate transfer member 31, and has two cleaning rollers 42 in contact with the photosensitive drum 11 and a rubber blade 43 capable of being kept in contact with the photosensitive drum 11.

The transferring and fixing means 50 has heating rollers 51 and 52. The heating rollers 51 and 52 contain a heater (not illustrated) respectively, and as shown in FIG. 5, the heating roller 51 on the upstream side in the feed direction of the recording paper S and the heating roller 52 on the downstream side are arranged in contact with the intermediate transfer member 31. The heating rollers 51 and 52 are integrally driven by a pressure mechanism not illustrated, to be pressed against the intermediate transfer member 31 when the multi-color toner image is heated and fixed onto the recording paper S, and as a result, the multi-color toner image transferred in lamination on the intermediate transfer member 31 is heated and pressurized to be fixed on the recording paper S.

The pressure mechanism keeps the heating rollers 51 and 52 away from the intermediate transfer member 31, when the toner images are transferred from the photosensitive drum 11 to the intermediate transfer member 31. Till the portion where the last one of the four toner images transferred exists on the intermediate transfer member 31 is reached, the heating rollers 51 and 52 are pressed against the intermediate transfer member 31 at a predetermined pressure by the pressure mechanism. Thus, the heating rollers 51 and 52 heat and pressurize the multi-color toner image transferred in lamination on the intermediate transfer member 31, for transferring and fixing it onto the recording paper S.

The pre-transfer charger 14 is a corona charger for charging the surface of the photosensitive drum 11 with the toner images developed into the same polarity as the toner images, i.e., toner particles. The pre-transfer charger 14 charges the surface of the photosensitive drum 11 with the toner images developed, in the same polarity as the toner particles by the ions generated by corona discharge, thereby letting repulsive force act between the toner image surface and the toner particles, to let the toner particles cohere on the surface of the photosensitive drums. At the same time, the surface of the latent image bearing member 11 is charged in the same polarity as the toner images, and as a result, also acts as a bias for transfer onto the intermediate transfer member.

The subsidiary squeeze means 60 has a subsidiary roller 61 and a pan 62. The subsidiary squeeze roller 61 rotates in the same direction as the photosensitive drum 11, and removes excess developer liquid, especially the liquid carrier from the surface of the photosensitive drum 11 with the toner images developed. The developer liquids adhering to the subsidiary squeeze roller 61 are removed by a scraper, and collected in a waste liquid tank through the pan 62 located below.

The electrophotographic printer 2 of the present invention is composed as described above, and prints a color image as described below.

At first, from the surface of the photosensitive drum 11 cleaned by the cleaning means 40, residual charges are removed by the discharger 12, and the surface of the photosensitive drum 11 is uniformly charged by the primary charger 13.

Then, a laser beam is applied from the exposing means, to form the electrostatic latent images based on color-separated print information on the surface of the photosensitive drum one after another. In this case, four electrostatic latent images corresponding to the respective colors of yellow, magenta, cyan and black are formed by the irradiation with a laser beam. The electrophotographic printer 2 has the squeeze rollers of the developing units 21 through 24 grounded through a capacitor.

So, in the case of an original containing both characters and pictures, the volume of printing information greatly varies within the one original, and the electrostatic latent image formed on the photosensitive drum 11 contains portions very large in surface potential due to small volumes of printing information and portions small and close to zero in surface potential due to large volumes of printing information. In this case, the bias voltage induced in the squeeze roller 212 corresponds to the surface potential of the electrostatic latent image on the photosensitive drum 11, and greatly varies. However, since the squeeze roller 212 is grounded through the capacitor C, the variation of the induced bias voltage can be kept small. Therefore, the electrophotographic printer 2 gets the excess developer liquid on the photosensitive drum 11 removed while the variation of the bias voltage induced in the squeeze roller 212 is kept small. For this reason, the electrophotographic printer 2 can present a printed image excellent in image quality without the printing unevenness attributable to the variation of the induced bias voltage. Then, the developing means 20 located on the right of the photosensitive drum 11 is moved horizontally toward the photosensitive drum 11 by a driving means not illustrated, to develop the yellow toner image by the first developing unit 21, the magenta toner image by the second developing unit 22, and similarly the cyan and black toner images one after another. The toner images developed by the respective developing units in this way are transferred onto the intermediate transfer member 31 one after another, to form a multi-color toner image with the four toner images laminated on the intermediate transfer member 31.

Concurrently with or after completion of the transfer of the toner image developed by the fourth developing unit 24 onto the intermediate transfer member 31, the heating rollers 51 and 52 are pressed against the intermediate transfer member 31 by the pressure mechanism, so that the multi-color toner image formed in lamination on the intermediate transfer member 31 is heated and pressurized, and transferred and fixed all at once onto the recording paper S fed, thus completing the recording of the color image.

If the recording of the multi-color toner image onto the recording paper S is completed, the pressure contact of the heating rolls 51 and 52 with the intermediate transfer member 31 by the pressure mechanism is released, and the developing means 20 is moved to the initial position on the right of the photosensitive drum 11 by the driving means.

In the above example, the squeeze rollers only in the developing units 21 through 24 are grounded through a capacitor. However, even if the developing rollers of the developing units 21 through 24 and the subsidiary roller 61 of the subsidiary squeeze means 60 are grounded similarly, the variation of the voltage induced by the self bias effect can be suppressed, to decrease the deterioration of image quality attributable to the voltage variation, needless to say. Furthermore, as shown in FIG. 6, the squeeze roller 212 and the subsidiary roller 61 may be short-circuited.

Figure 6:
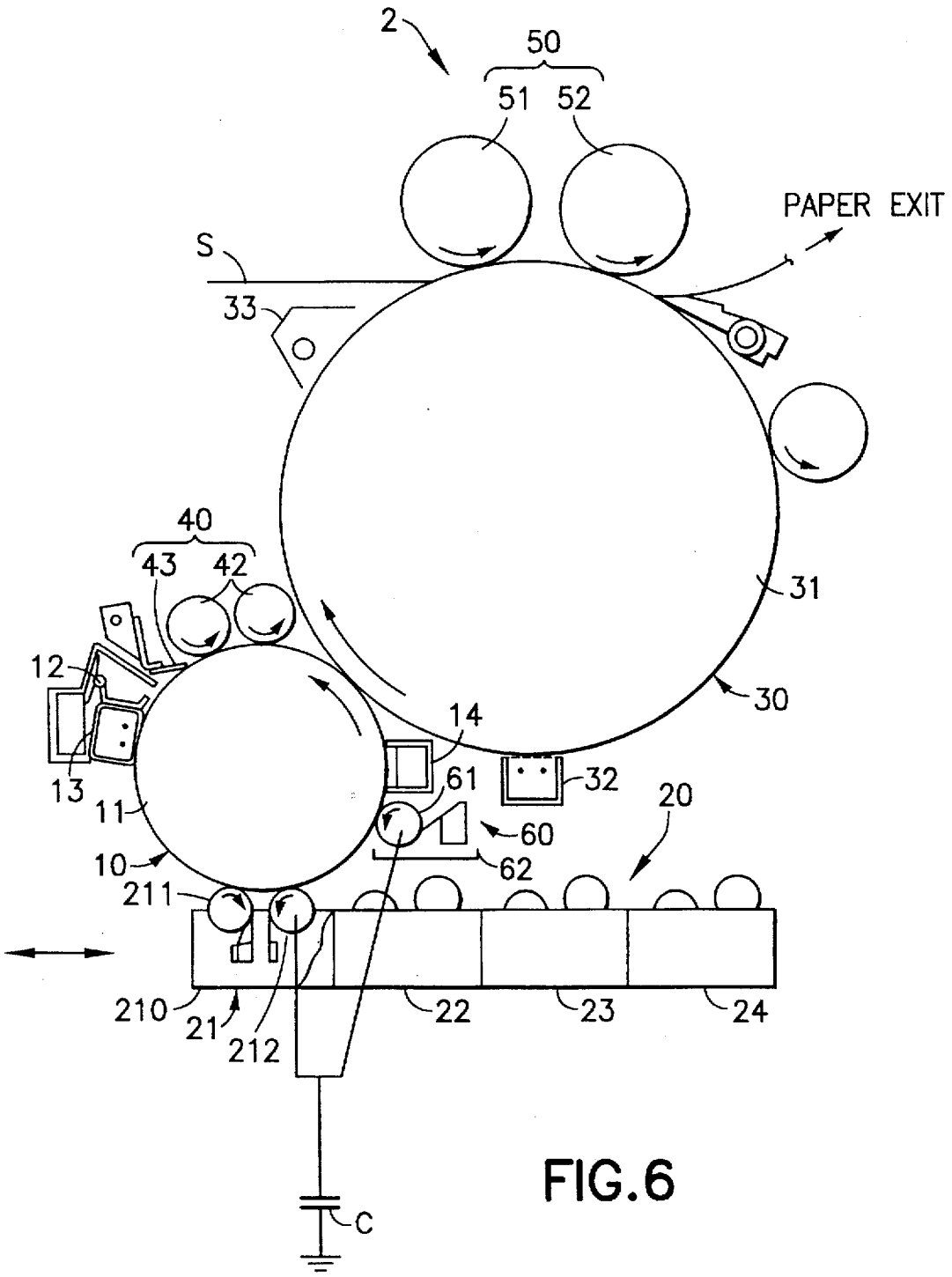
FIG. 6 is a front view showing the major portion of an electrophotographic printer as a still further other example of the printing apparatus and printing method of the present invention.

In the case of FIG. 6, the squeeze roller 212 and the subsidiary 61 respectively have bias voltages induced in correspondence to the surface potential of the electrostatic latent image of the photosensitive drum 11 at the corresponding position.

However, the squeeze roller 212 and the subsidiary roller 61 are electrically short-circuited. As a result, in the squeeze roller 212 and the subsidiary roller 61, the induced bias voltages are further averaged, to stabilize the potential variation. Therefore, in the electrophotographic printer 2, it does not happen that either of the induced bias voltages becomes close to zero, to inhibit the squeeze function, thereby lowering the quality of the image obtained.

In addition, in this case, if the squeeze roller 212 and the subsidiary roller 61 are electrically short-circuited and held to electrically float, being grounded through the capacitor C as shown in FIG. 6, the variation of the induced bias voltage can be further suppressed to further improve the quality of the image obtained. It is needless to say that the squeeze roller and the subsidiary roller are short-circuited, however, even if the squeeze roller and the subsidiary roller are not short-circuited grounded through a capacitor, they act to stabilize the potential.

Figure 7:
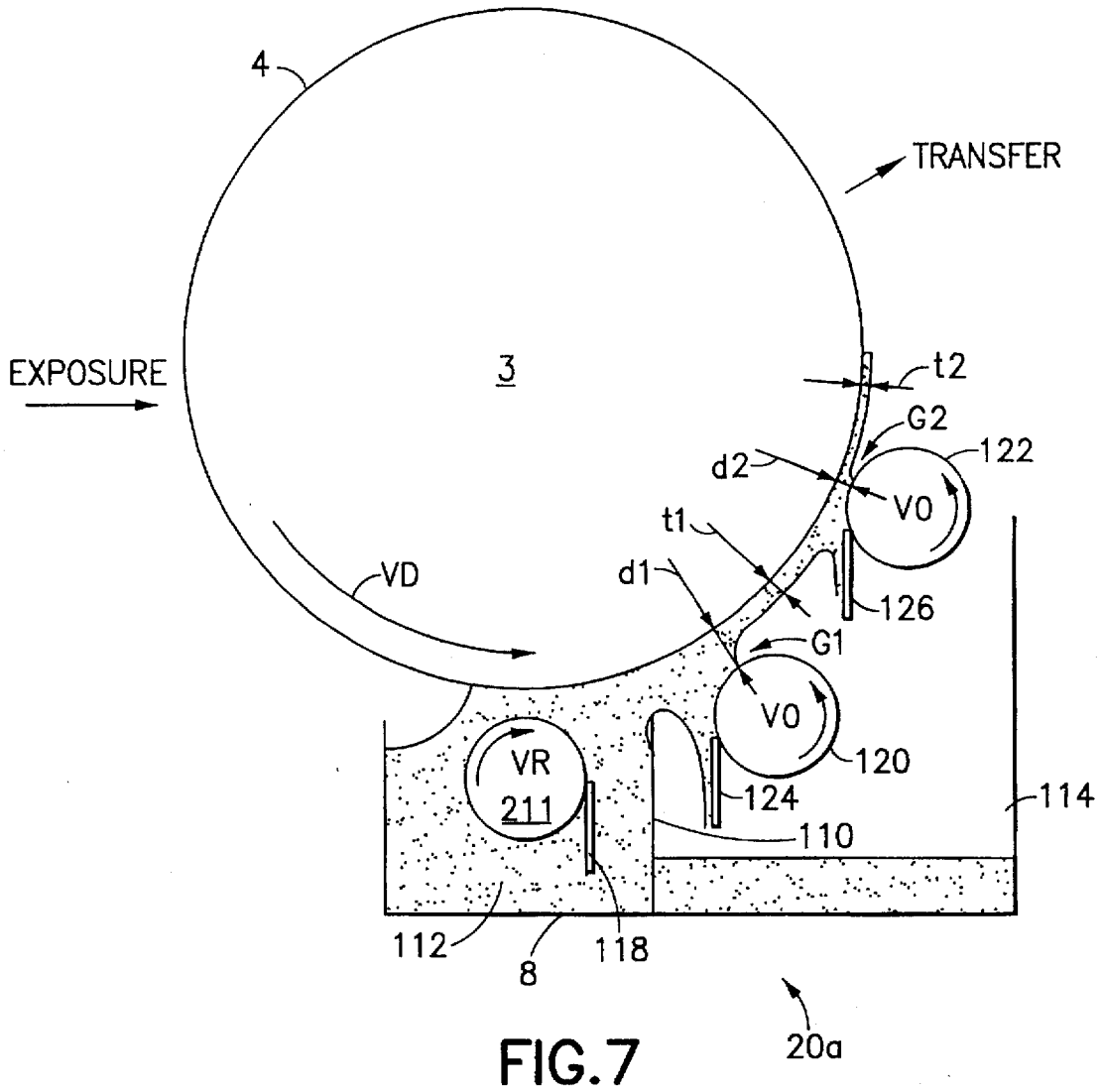
FIG. 7 is a front view showing the structure of the developing means of an electrophotographic printer as a still further other example of the present invention.

Preferable embodiments of the means for removing the developer liquids which may be applied to any of the above Examples 1 to 3 are described below in reference to FIGS. 7 to 9. FIG. 7 schematically shows part of an electrophotographic apparatus contained in a laser printer or copier, and the electrophotographic apparatus is provided with a photosensitive drum 3. The photosensitive drum 3 has a photosensitive face 4 formed as an image carrier around it. The photosensitive drum 3 is rotated at a constant circumferential speed VD counterclockwise in FIG. 7.

Immediately below the photosensitive drum 3, a wet developing device 20*a* concerned with the preferable embodiment of the developer liquid removing means is provided, and it has a developing chamber 8. The developing chamber 8 is open at the top, and is internally divided into a developing compartment 112 and a recovery compartment 114 by a partition 110. In the rotating direction of the photosensitive drum 3, the developing compartment 112 is located upstream of the recovery compartment 114, and it gets a developer constantly supplied in it.

In the developing compartment 112, a developing roller 211 is provided at a position close to the photosensitive drum 3, and it is rotated at a constant circumferential speed VR clockwise in FIG. 7. Therefore, the developing roller 211 supplies the developer toward the photosensitive face 4 of the photosensitive drum 3 by its rotation.

On the right of the developing roller 211, a scraper 118 is provided, and its top end contacts the circumferential face of the developing roller 211.

In the recovery compartment 114, a first squeeze member 120 and a second squeeze member 122 respectively like a roll are arranged in this order from the partition 110 side along the circumferential face of the photosensitive drum 3. That is, in the moving direction of the photosensitive face 4, the first squeeze member 120 is located upstream of the second squeeze member 122. The first and second squeeze members 120 and 122 may be fixed, but in this embodiment, they are rotated at the same circumferential speed V0 counterclockwise in FIG. 7. The circumferential speed of the developing roller 211, and the circumferential speed of the first and second squeeze members 120 and 122 are set at predetermined ratios to the circumferential speed VD of the photosensitive drum 2.

The distance d1 of the first gap G1 formed between the first squeeze member 120 and the photosensitive drum 3 is larger than the distance d2 of the second gap G2 formed between the second squeeze member 122 and the photosensitive drum 3.

The first and second squeeze members 120 and 122 have their scrapers 124 and 126 arranged on their left respectively. The top ends of the scrapers 124 and 126 contact the circumferential faces of the respective squeeze members. If the photosensitive drum 3 is rotated to expose the photosensitive face 4, a latent image is formed on the photosensitive face 4. If the latent image on the photosensitive face 4 reaches the developing device 20*a*, the developing device 20*a* executes development according to the following method.

At first, if the latent image on the photosensitive face 4 reaches above the developing chamber 8, the developer is supplied to the latent image for development, to obtain a toner image on the photosensitive face 4.

Subsequently, according to the rotation of the photosensitive drum 3, the toner image passes the first and second squeeze members 120 and 122 in this order, to get the excess developer on the photosensitive drum 3 to be removed stepwise.

Concretely, when the excess developer on the photosensitive drum 3 passes through the first gap G1 between the photosensitive drum 3 and the first squeeze member 120, it is partially removed by the first gap G1, and the liquid layer decreases to t1 in thickness.

When the remaining excess developer passes through the second gap G2 between the photosensitive drum 3 and the second squeeze member 122, the remaining excess developer is further removed by the second gap G2 to a required level, causing the liquid layer to be decreased from t1 to t2 in thickness, since the distance d2 of the second gap G2 is smaller than the distance d1 of the first gap G1.

The excess developer adhering to the circumferential faces of the first and second squeeze members 120 and 122 is removed by their scrapers 124 and 126.

If the excess developer on the photosensitive face 4 is removed stepwise as described above, the distances d1 and d2 of the first and second gaps G1 and G2 can be independently set in correspondence to the quantity of the excess developer on the photosensitive face 4. Therefore, the excess developer can be reasonably removed without disturbing the toner image formed on the photosensitive face 4.

Then, the toner image on the photosensitive face 4 is transferred onto the intermediate transfer member (not illustrated) or the recording paper (not illustrated) as a recording medium at the transfer position, and fixed on the recording paper.

Figure 8:
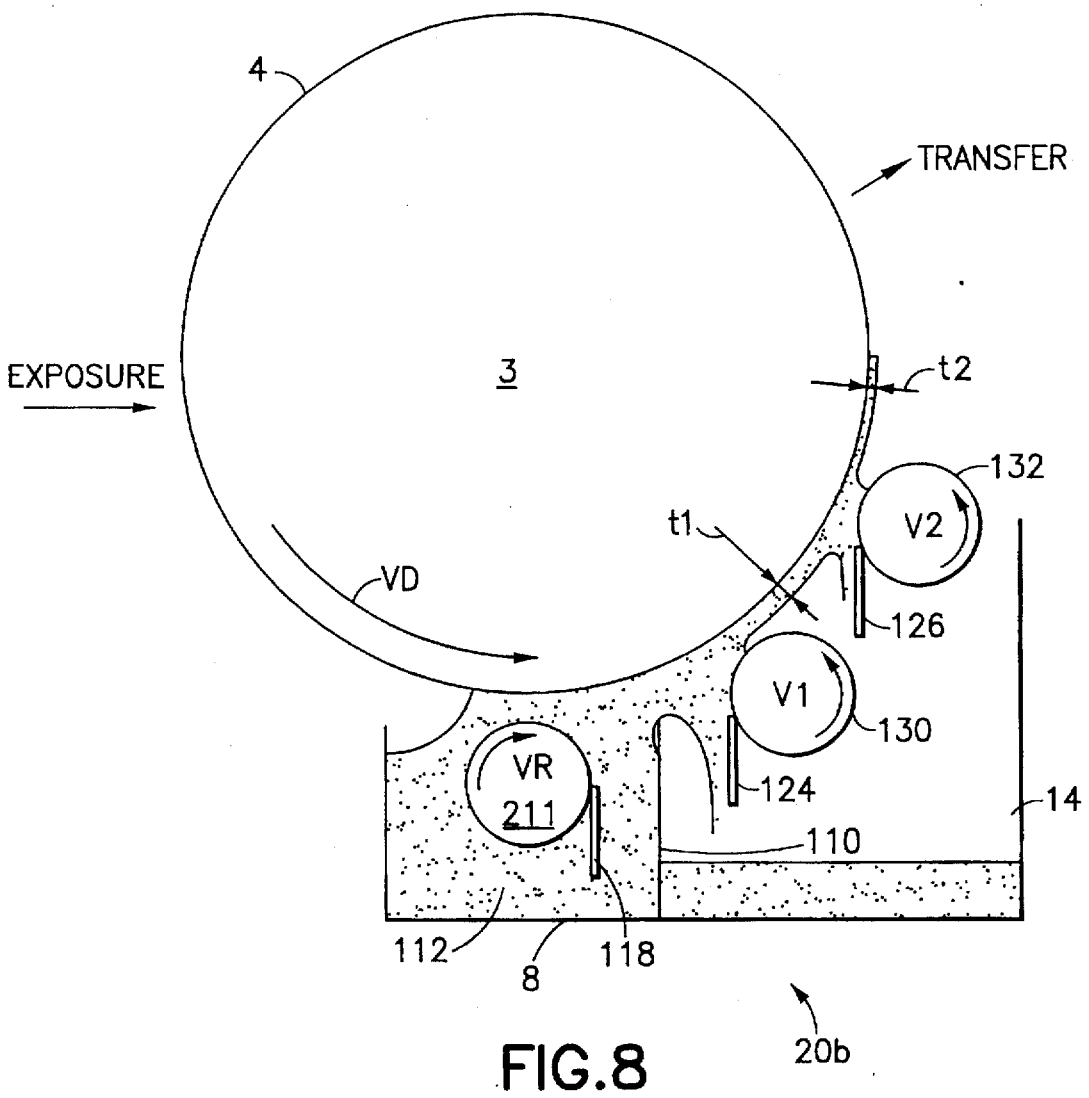
FIG. 8 is a front view showing the structure of another developing means of an electrophotographic printer as a still further other example of the present invention.

FIG. 8 shows a developing device 20*b* concerned with another preferable embodiment of the developer liquid removing means. In the developing device 20*b*, the first and second squeeze members 120 and 122 of the developing device 20*a* are substituted by first and second squeeze rollers 130 and 132, and the other configuration is the same as in the developing means described before (FIG. 7).

The first and second squeeze rollers 130 and 132 are arranged to keep the same gap against the photosensitive drum 3, unlike the first and second squeeze members 120 and 122, but are different in circumferential speed. That is, in this embodiment, the circumferential speed V2 of the second squeeze roller 132 is lower than the circumferential speed V1 of the first squeeze roller 130.

In the development method by the developing device 20*b*, when the excess developer on the photosensitive face 4 passes over the first squeeze roller 130, the excess developer is partially scraped off by its high speed rotation, and the liquid layer is decreased to t1 in thickness. Subsequently, when the remaining excess developer passes over the second squeeze roller 132, the remaining excess developer is scraped off further to a desired level by its rotation since the excess developer remains to well adhere to the second squeeze member 132 even if the remaining excess developer layer is thin because the circumferential speed V2 of the second squeeze roller 132 is lower than the circumferential speed V1 of the first squeeze roller 130.

Also in the embodiment of FIG. 8, since the circumferential speeds V1 and V2 of the first and second squeeze rollers 130 and 132, i.e., the scraping-off speeds can be set independently in correspondence to the quantity of the excess developer on the photosensitive face 4, the excess developer can be reasonably removed without disturbing the toner image formed on the photosensitive face 4.

Figure 9:
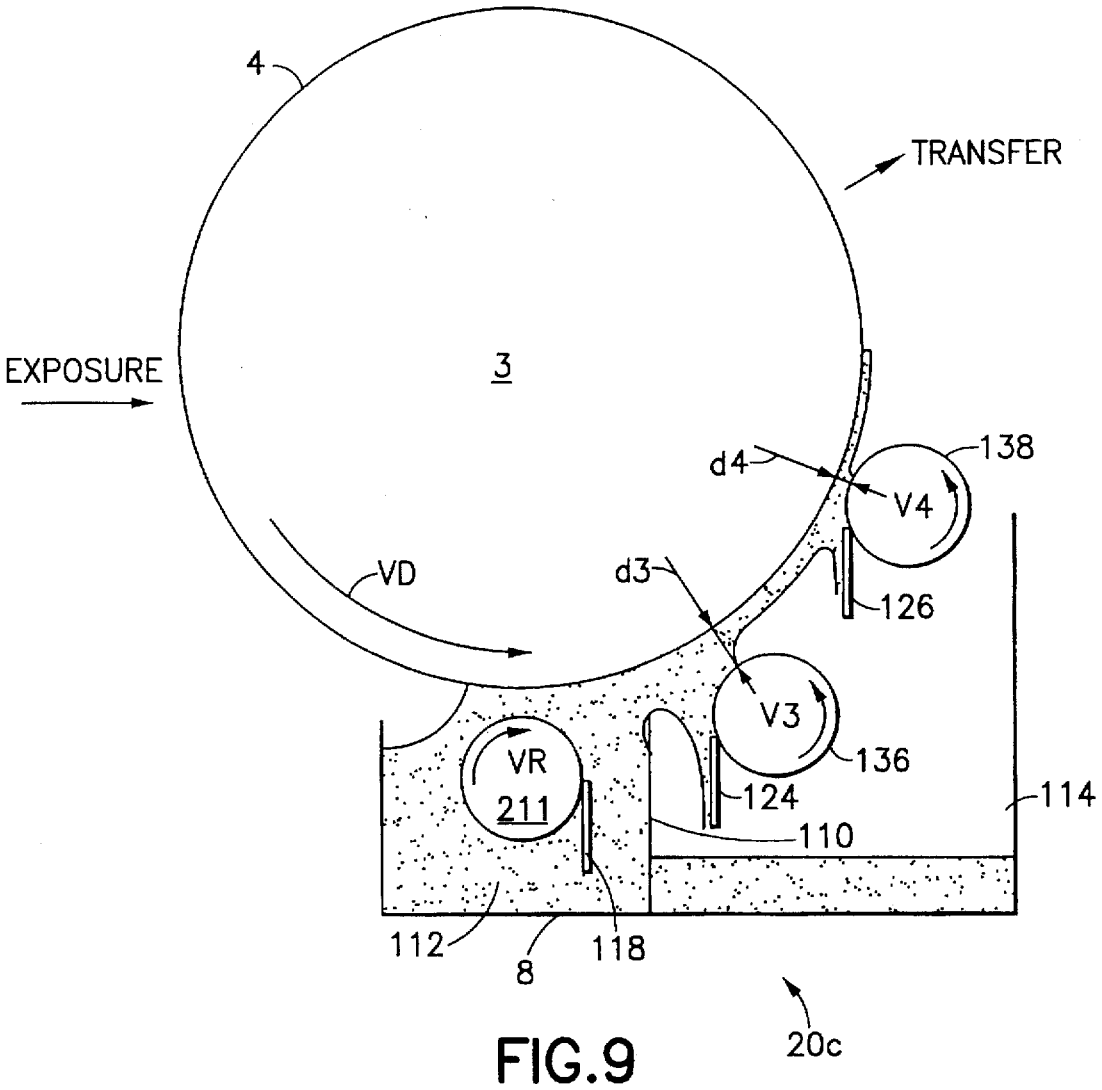
FIG. 9 is a front view showing the structure of a further other developing means of an electrophotographic printer as a still further other example of the present invention.

FIG. 9 shows a developing device 20*c* concerned with a further other preferable embodiment of the developer liquid removing means. The developing device 20*c* have a first squeeze roller 136 and a second squeeze roller 138 which have both the function of the first and second squeeze members 120 and 122 of the embodiment shown in FIG. 7 and the function of the first and second squeeze members 130 and 132 of the embodiment shown in FIG. 8. That is, the distance d3 of the first gap between the first squeeze roller 136 and the photosensitive drum 3 is larger than the distance d4 of the second gap between the second squeeze roller 138 and the photosensitive drum 3, and the circumferential speed V4 of the second squeeze roller 138 is lower than the circumferential speed V3 of the first squeeze roller 136.

According to the developing device and developing method of the embodiment shown in FIG. 9, since the development methods in the embodiment shown in FIG. 7 and the embodiment shown in FIG. 8 are concurrently executed, the excess developer can be more effectively removed from the photosensitive drum 3, compared to the previous two embodiments.

The above developing means and developing methods not limited to the embodiments shown in FIGS. 7 to 9 may be adopted for the printing apparatus and printing method of the present invention. For example, in the developing device of the embodiment shown in FIG. 9, the distances d3 and d4 may be made equal to the distances d1 and d2, and the circumferential speeds V3 and V4 may also be made equal to the circumferential speeds V1 and V2 respectively.

In the printing apparatus and printing method of the present invention which adopt any of the above described developing means and developing methods, if the gaps formed by the squeeze members are adjusted, the excess developer liquid can be reasonably removed in the respective steps. In this case, if the squeeze members are rotating rollers, the excess developer liquid can-be removed more stably preferably. Furthermore, if the circumferential speeds of the squeeze rollers are adjusted, the excess developer liquid can be reasonably scraped off in the respective steps.

INDUSTRIAL APPLICABILITY

The present invention can present a printing apparatus and a printing method which can suppress the reverse transfer of the toner images onto the photosensitive member when the toner images are transferred in lamination onto the intermediate transfer member, for example, in an electrophotographic printer.

We claim:

1. A printing apparatus which comprises means for forming latent images on a latent image bearing member, means for developing each formed latent image to form a toner image, and means for electrically transferring said toner images from the latent image bearing member onto an intermediate transfer member, for recording onto a recording medium, comprising;

a charger for charging the surface of the intermediate transfer member to the same polarity as the toner image after each transfer of a toner image from the latent image bearing member onto the intermediate transfer member but prior to each successive transfer of a next toner image thereto from the latent image bearing member so as to erase the influence of the previous toner image and facilitate the transfer of the next toner image without reversing the polarity of the previous toner image, and a means for suppressing variation of the potential on the surface of the intermediate transfer member caused by the successive charging by the charger to sustain the bias electric field for enabling the successive transfer of the toner images from the latent image bearing member to the intermediate transfer member.

2. A printing apparatus according to claim 1, comprising means for developing each latent image on the latent image bearing member by developer liquid; means for removing excess developer liquid from the latent image bearing member with the latent image developed; and means associated with the developing means and/or the removing means for suppressing the potential induced by the latent image bearing member, grounded through a capacitor.

3. A printing apparatus according to claim 1, wherein the developing means develops a latent image on the latent image bearing member by developer liquid; and plural removing means are provided to remove excess developer liquid from the latent image bearing member with the latent image developed, and the plural removing means are electrically short-circuited.

4. A printing apparatus according to claim 1, wherein the developing means develops a latent image on the latent image bearing member by developer liquid; and plural squeeze members for removing excess developer liquid from the latent image bearing member with the latent image developed are arranged along the moving direction of the latent image bearing member, while the squeeze member on the downstream side in the moving direction of the latent image bearing member is located more closely to the latent image bearing member than the squeeze member on the upstream side.

5. A printing apparatus according to claim 1, wherein the developing means develops a latent image on the latent image bearing member by developer liquid; and plural squeeze members for removing excess developer liquid from the latent image bearing member with the latent image developed are arranged along the moving direction of the latent image bearing member, while the squeeze member on the downstream side in the moving direction of the latent image bearing member is lower in circumferential speed than the squeeze member on the upstream side.

6. A printing apparatus according to claim 1, wherein the developing means develops a latent image on the latent image bearing member with developer liquid, and has a developing roller arranged to keep a clearance against the latent image bearing member, the developing roller being rotated at a speed to keep the developer liquid in the developing region stable over the full width of the developing roller.

7. A printing apparatus according to claim 1, wherein the developing means develops a latent image on the latent image bearing member by developer liquid, and has developing roller arranged to keep a clearance against the latent image bearing member, the developing roller having its surface moved in the same direction as the surface of the latent image bearing member, and being rotated at a circumferential speed corresponding to 0.5 to 3 times the circumferential speed of the latent image bearing member.

8. A printing apparatus according to claim 1, further comprising:

a pre-transfer charger for charging the surface of the latent image bearing member to the same polarity as the toner image before the toner image on the latent image bearing member is transferred onto the intermediate transfer member.

9. A printing apparatus according to claim 1, wherein the suppressing means comprises a surface insulation layer forming the surface of the intermediate transfer member and having a predetermined dielectric thickness.

10. A printing apparatus according to claim 9, wherein the dielectric thickness of the surface insulation layer is not more than 5 μm.

11. A printing apparatus according to claim 1, wherein the suppressing means comprises a scorotron-type corona charger which is applied as the charger.

12. A printing method which comprises forming latent images on a latent image bearing member, developing each formed latent image by a developing means to form a toner image, and electrically transferring each of the toner images from the latent image bearing member onto an intermediate transfer member which is charged to the same polarity as the toner image, characterized by the step of charging the surface of the intermediate transfer member to the same polarity as the toner image, after each transfer of a toner image from the latent image bearing member onto the intermediate transfer member, but prior to each successive transfer of a next toner image from the latent image bearing member to the intermediate transfer member so as to erase the influence of the previous toner image and facilitate the transfer of the next toner image without reversing the polarity of the previous toner image, and suppressing variation of the potential on the surface of the intermediate transfer member caused by the successive charging of the surface to sustain the bias electric field and enable the successive transfer of the toner images from the latent image bearing member to the intermediate transfer member.

13. A printing method according to claim 12, wherein the latent image on the latent image bearing member is developed using developer liquid, and excess developer liquid is removed from the latent image bearing member after development of the latent image, using plural removing means kept at the same potential.

14. A printing method according to claim 12, wherein the latent image on the latent image bearing member is developed using developer liquid, and excess developer liquid on the latent image bearing member is removed after development, by letting the developer liquid pass through plural gaps sequentially made smaller in the moving direction of the latent image bearing member.

15. A printing method according to claim 12, wherein the latent image on the latent image bearing member is developed using developer liquid, and the developer liquid on the latent image bearing member is scraped off after development, by letting the developer liquid pass through plural gaps sequentially made smaller in the moving direction of the latent image bearing member, with the scraping-off speed in the passage through the downstream gap kept lower than that in the passage through the upstream gap.

16. A printing method according to claim 12, wherein when the latent image on the latent image bearing member is developed, a developing region is formed by developer liquid supplied between the latent image bearing member and the developing roller arranged to keep a clearance, and the developing roller is rotated for development at a speed to keep the developer liquid in the developing region stable over the full width of the developing roller.

17. A printing method according to claim 12, wherein when the latent image on the latent image bearing member is developed, a developing region is formed by developer liquid supplied between the latent image bearing member and the developing roller arranged to keep a clearance, and the developing roller having its surface moved in the same direction as the surface of the latent image bearing member, and being rotated for development at a circumferential speed corresponding to 0.5 to 3 times the circumferential speed of the latent image bearing member.

18. A printing method according to claim 12, further comprising:

a step of charging the surface of the latent image bearing member to the same polarity as the toner image before the toner image on the latent image bearing member is transferred onto the intermediate transfer member.

19. A printing method according to claim 12, which comprises suppressing the potential variation by means of a surface insulation layer forming the surface of the intermediate transfer member and having a predetermined dielectric thickness.

20. A printing method according to claim 19, wherein the dielectric thickness of the surface insulation layer is not more than 5 μm.

21. A printing method according to claim 12 which comprises the potential variation by means of a scorotron-type corona charger which is applied as the charger.

22. A printing apparatus, in which a latent image is formed on a latent image bearing member, the latent image is developed by developer liquid to form a toner image, and the toner image on the latent image bearing member is electrically transferred onto an intermediate transfer member, for recording onto a recording medium, comprising:

plural squeeze rollers for removing excess developer liquid from the latent image bearing member, carrying the developed latent image, said rollers being arranged along the moving direction of the latent image bearing member, wherein the squeeze roller on the downstream side in the moving direction of the latent image bearing member is lower in circumferential speed than the squeeze roller on the upstream side.

23. A printing method in which a latent image is formed on a latent image bearing member, the latent image is developed by developer liquid to form a toner image, and the toner image on the latent image bearing member is electrically transferred onto an intermediate transfer member, for recording onto a recording medium;

wherein excess developer liquid on the latent image bearing member is scraped off after development, by causing the developer liquid to pass through plural gaps, at a slower scraping off speed through a downstream gap in the moving direction of the latent image bearing member than the scraping off speed through an upstream gap.

24. A printing apparatus comprising a latent image bearing member, means for forming latent images on said latent image bearing member, means for developing said latent images to form toner images of fixed polarity, electrical means for transferring said toner images onto an intermediate transfer member, and means for transferring said toner images onto a recording medium, characterized by the presence of means for charging the surface of the intermediate transfer member to the same polarity as the toner images after each transfer of toner images from said latent image bearing member onto the charged surface of said intermediate transfer member but prior to each successive transfer of toner images thereto from said latent image bearing member, to increase the electrostatic attractive force between the toner images and the intermediate transfer member and decrease the reverse transfer when successive toner images are transferred thereto so as to erase the influence of the previous toner images on said intermediate transfer member without reversing the polarity of the previous toner image and to facilitate the transfer of the successive toner images thereto, and a means for suppressing variation of the potential on the surface of the intermediate transfer member caused by the successive charging by the charger to sustain the bias electric field for enabling the successive transfer of the toner images from the latent image bearing member to the intermediate transfer member.

25. A continuous printing method comprising the steps of forming latent images on the surface of a photosensitive member to form a latent image bearing member, developing said latent images to form toner images having a fixed polarity, electrically transferring said toner images onto an intermediate transfer member, and transferring said toner images onto a recording member, characterized by the step of charging the surface of the intermediate transfer member to the same polarity as the toner images after each transfer of toner images from said latent image bearing member onto the charged surface of said intermediate transfer member but prior to each successive transfer of a next toner image from the latent image bearing member to the intermediate transfer member, so as to erase the influence of the polarity of the previous toner images on said intermediate transfer member and to facilitate the transfer of the next toner images thereto without reversing the polarity of the previous toner image, and suppressing variation of the potential on the surface of the intermediate transfer member caused by the successive charging of the surface to sustain the bias electric field and enable the successive transfer of the toner images from the latent image bearing member to the intermediate transfer member.

26. A printing method according to claim 25 comprising the steps of developing said latent images on the latent image bearing member using liquid developer, removing at least some of the excess developer liquid from the latent image bearing member, and suppressing at least some of the variation in the potential induced in the developing means and/or in the removing means by the latent image bearing member.

* * * * *